US006341205B1

(12) United States Patent
Yoshino et al.

(10) Patent No.: US 6,341,205 B1
(45) Date of Patent: Jan. 22, 2002

(54) IMAGE FORMING APPARATUS WITH CLEANING BIAS FEATURE

(75) Inventors: Naoto Yoshino; Masaaki Takahashi, both of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/627,300

(22) Filed: Jul. 27, 2000

(30) Foreign Application Priority Data

Sep. 8, 1999 (JP) ..... 11-254684
Sep. 14, 1999 (JP) ..... 11-260362

(51) Int. Cl.[7] ..... G03G 15/16
(52) U.S. Cl. ..... 399/101; 399/66
(58) Field of Search ..... 399/66, 98, 99, 399/101, 297, 298, 302, 308

(56) References Cited

U.S. PATENT DOCUMENTS 5,337,127 A * 8/1994 Imaue ..... 399/101
5,671,464 A * 9/1997 Kubota ..... 399/101
5,717,981 A * 2/1998 Yamanaka ..... 399/101
5,732,314 A * 3/1998 Tsukida et al. ..... 399/302
5,752,130 A * 5/1998 Tanaka et al. ..... 399/101
6,097,919 A * 8/2000 Takeuchi et al. ..... 399/298
6,163,661 A * 12/2000 Namekata et al. ..... 399/66 X

FOREIGN PATENT DOCUMENTS

JP 8-272235 10/1996
JP 8-328401 12/1996
JP 9-6146 1/1997

* cited by examiner

*Primary Examiner*—Sandra Brase
(74) *Attorney, Agent, or Firm*—Morgan, Lewis & Bockius LLP

(57) ABSTRACT

There is provided an image forming apparatus capable of finely cleaning a transfer roll at all times by regulating the relation between a mechanical adhesion force of toner to the surface of the transfer roll and a mechanical adhesion force of toner to the surface of an image carrier with which the transfer roll comes in press contact. At the time of cleaning the transfer roll, both the electrostatic adhesion force and the mechanical adhesion force of charged colorant to the surface of the belt-like image carrier are set larger than the electrostatic adhesion force and the mechanical adhesion force of charged colorant to the surface of the transfer roll.

4 Claims, 10 Drawing Sheets

53Y, 53M, 53C, 53BK, 54Y, 54M, 54C
: PATCH FOR PROCESS CONTROL 55Y, 55M, 55C, 55BK, 56Y, 56M, 56C, 56BK
: PATCH FOR REGISTRATION CONTROL

IMAGE FORMING APPARATUS WITH CLEANING BIAS FEATURE

BACKGROUND OF THE INVENTION

1. Field of the Invention

The present invention relates to an image forming apparatus using an electrophotographic system, such as a copying machine or a laser printer, in which an image is formed by secondarily transferring a toner image to a recording medium from an intermediate transfer body on which the toner image has been transferred, and particularly to a cleaning technique of a transfer part in a secondary transfer portion.

2. Description of the Related Art

Conventionally, as an image forming apparatus using an electrophotographic system, such as the copying machine or laser printer, there is an image forming apparatus constructed such that toner images of yellow, magenta, cyan, black, etc. sequentially formed on a photoreceptor drum are transferred onto an intermediate transfer belt in a state where they overlap with each other, the multiple toner images of the respective colors transferred onto the intermediate transfer belt are transferred to a recording medium at the same time by pressing force and electrostatic attraction force of a backup roll and a secondary transfer roll, and then, the unfixed toner images of the respective colors are fixed onto the recording medium by a fixing device, whereby a color image is formed.

In the image forming apparatus, the secondary transfer roll is brought into press contact with the intermediate transfer belt on which the toner images of the respective colors have been transferred, and the multiple transferred toner images on the intermediate transfer belt are secondarily transferred onto the recording medium, so that the color image is formed. Thus, in the image forming apparatus, when the toner image transferred onto the intermediate transfer belt comes in contact with the secondary transfer roll, the toner is shifted to the secondary transfer roll by the pressing force, and the toner sticking to the secondary transfer roll adheres to the rear surface of the recording medium next conveyed to a secondary transfer position, which becomes a cause of rear surface stain of the recording medium.

For the purpose of preventing such rear surface stain of a recording medium caused by adhesion of toner to a secondary transfer roll, in an image forming apparatus using a transfer roll including a secondary transfer roll, a technique of cleaning the secondary transfer roll or the like has been already proposed in Japanese Patent Unexamined Publication No. Hei. 8-272235, No. Hei. 8-328401, and No. Hei. 9-6146.

An image forming apparatus disclosed in Japanese Patent Unexamined Publication No. Hei. 8-272235 includes an image carrier which electrostatically holds a toner image, a transfer member which comes in contact with the surface of the image carrier and applies a transfer bias, and a bias application part which sequentially applies bias currents having different polarities to the transfer member when a transfer material does not exist at a transfer position. In the image forming apparatus, the bias application part applies the same polarity current having the same polarity as the toner constituting the toner image, and then, applies the opposite polarity current having the polarity opposite to the toner and having a current value of an absolute value not lower than an absolute value of the same polarity current.

An image forming apparatus disclosed in Japanese Patent Unexamined Publication No. Hei. 8-328401 includes an image carrier which electrostatically holds a toner image, a transfer member which comes in contact with the surface of the image carrier and applies a transfer bias, and a bias application part which applies the transfer bias to the transfer member when a transfer material passes between the image carrier and the transfer member so as to transfer the toner image formed on the image carrier to the transfer material, and applies a current having a polarity opposite to the charged polarity of the toner to the transfer member after applying a current having the same polarity as the charged polarity of the toner at the time of cleaning when the transfer material does not exist at a transfer position. In the image forming apparatus, a bias having the same polarity as the transfer bias is applied to the transfer member at least in the period from the start of first image formation immediately after the cleaning to the application of the transfer bias.

An image forming apparatus disclosed in Japanese Patent Unexamined Publication No. Hei. 9-6146 includes a photoreceptor on which a toner image corresponding to an image to be formed is formed, a primary transfer member which transfers the toner image on the photoreceptor onto an intermediate transfer body, a secondary transfer member which is provided to be freely pressed on and separated from the intermediate transfer body and transfers the toner image on the intermediate transfer body onto a recording sheet, and an intermediate transfer body driving part which rotates and drives the intermediate transfer body. The image forming apparatus further includes a cleaner blade which is provided to be freely pressed on and separated from the intermediate transfer body and removes the toner image on the intermediate transfer body, a secondary transfer member holding part which holds the secondary transfer member while selectively changing a press contact state and a separating state to the intermediate transfer body, a cleaner blade holding part which holds the cleaner blade while selectively changing a press contact state and a separating state to the intermediate transfer body, a paper jam detection part which detects a paper jam in a recording sheet conveying passage, a paper jam release detection part which detects that a paper jam state is released, a voltage application part which applies a voltage to the secondary transfer member, and a control part which controls the operation of the respective holding parts, the driving part, and the voltage application part on the basis of detection signals by the respective detection parts. The control part performs such control that after the release of the paper jam state is detected, the cleaner blade is held in the press contact state to the intermediate transfer body, the secondary transfer member is held in the separating state to the intermediate transfer body, cleaning on the intermediate transfer body is performed while the intermediate transfer body is caused to make at least one rotation, the secondary transfer member is held while the press contact state to the intermediate transfer body is changed after the intermediate transfer body is cleaned, a voltage is applied to the secondary transfer member, and cleaning of the secondary transfer member is performed while the secondary transfer member is caused to make at least one rotation.

However, the foregoing prior art has the following problems. That is, in the technique disclosed in Japanese Patent Unexamined Publication No. Hei. 8-272235 or No. Hei. 8-328401, at the time of cleaning when the recording medium does not exist at the transfer position, the voltage having the same polarity as the charged polarity of the toner is applied to the transfer part, and then, the voltage having the polarity opposite to the charged polarity of the toner is applied, so that the toner sticking to the transfer part is completely reversely transferred onto the image carrier, and the rear stain of the recording medium is prevented. In the technique disclosed in Japanese Patent Unexamined Publication No. Hei. 9-6146, the contact and separation control of the cleaner blade and the secondary transfer member is performed, so that cleaning of the toner remaining on the intermediate transfer body and the secondary transfer member after the release of the paper jam can be effectively performed, and in the image forming operation carried out after the release of the paper jam, the stain such as fogging or stripes due to the remaining toner is not produced, a clear image can be formed, and the image quality of the formed image is improved.

However, there has been a problem that even if a constant cleaning voltage is applied to the transfer part, if consideration is not paid to the relation between the mechanical adhesion force of toner to the surface of the secondary transfer roll or the like as the transfer part and the adhesion force of toner to the surface of the image carrier with which the secondary transfer roll comes in contact, it is impossible to effectively remove the toner adhered to the surface of the secondary transfer roll or the like as the transfer part, and the surface of the secondary transfer roll can not be finely cleaned.

As a result, in the image forming apparatus such as a color copying machine, the cleaning part for applying the cleaning voltage to the secondary roll is made auxiliary, and the blade for cleaning the surface of the secondary transfer roll is used as a main cleaning part. Thus, there has been a problem that the surface of the secondary transfer roll is abraded by the press contact of the blade, and the life becomes short. Especially in the case where a color image is formed, the amount of toner to be cleaned is about 4 times as large as that of a black-and-white image, so that the cleaning part for applying the cleaning voltage to the secondary transfer roll is insufficient, and the load by the blade is large.

SUMMARY OF THE INVENTION

The present invention has been made to solve the problems of the prior art and provides an image forming apparatus which can finely clean a transfer roll at all times by regulating the relation between a mechanical adhesion force of toner to the surface of a transfer roll and a mechanical adhesion force of toner to the surface of an image carrier with which the transfer roll comes into press contact.

In order to solve the problems, according to an aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that at the time of cleaning the transfer roll, both an electrostatic adhesion force and a mechanical adhesion force of the charged colorant to the surface of the belt-like image carrier are set larger than an electrostatic adhesion force and a mechanical adhesion force of the charged colorant to the surface of the transfer roll.

Besides, according to another aspect of the present invention, in the foregoing image forming apparatus, a part which sets the electrostatic adhesion force of the charged colorant to the surface of the belt-like image carrier larger than the electrostatic adhesion force of the charged colorant to the surface of the transfer roll includes a part which applies a cleaning bias voltage having a polarity opposite to the transfer bias voltage to at least one of the backup roll and the transfer roll.

Besides, according to another aspect of the present invention, in the foregoing image forming apparatus, a part which sets the mechanical adhesion force of the charged colorant to the surface of the belt-like image carrier larger than the mechanical adhesion force of the charged colorant to the surface of the transfer roll includes a part which sets surface energy of the belt-like image carrier larger than surface energy of the transfer roll.

Besides, according to another aspect of the present invention, in the foregoing image forming apparatus, a contact angle of water on the surface of the belt-like image carrier is set to 70° to 80°, and a contact angle of water on the surface of the transfer roll is set to 85° to 100°.

Besides, according to another aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that a cleaning bias voltage having a polarity opposite to the transfer bias voltage is applied to at least one of the backup roll and the transfer roll, and an output value of the cleaning bias voltage is controlled so that a potential difference between the belt-like image carrier and the transfer roll becomes optimum for cleaning.

Besides, according to another aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that a cleaning bias voltage having a polarity opposite to the transfer bias voltage is applied to at least one of the backup roll and the transfer roll, and an output value of the cleaning bias voltage is controlled according to a system resistance between the backup roll and the transfer roll.

Besides, according to another aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that a cleaning bias voltage having a polarity opposite to the transfer bias voltage is applied to at least one of the backup roll and the transfer roll, and an output value of the cleaning bias voltage is controlled according to an environmental variation.

Besides, according to another aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that a cleaning bias voltage having a polarity opposite to the transfer bias voltage is applied to at least one of the backup roll and the transfer roll, and an output value of the cleaning bias voltage is controlled according to a use history of the image forming apparatus.

Besides, according to another aspect of the present invention, an image forming apparatus includes a belt-like image carrier which holds a visible image with a charged colorant and is circularly moved, a transfer roll which is disposed to be brought into press contact with a front surface of the image carrier through a recording medium and collectively transfers the visible image on the image carrier onto the recording medium, a backup roll which is disposed opposite to the transfer roll to be brought into press contact with a rear surface of the belt-like image carrier and forms a predetermined width transfer nip region to the transfer roll, and a transfer bias application part which applies a transfer bias voltage to at least one of the backup roll and the transfer roll, in which the image forming apparatus is characterized in that a cleaning bias voltage having a polarity opposite to the transfer bias voltage is applied to at least one of the backup roll and the transfer roll, and a resistor of a predetermined value corresponding to a system resistance between the backup roll and the transfer roll is provided between a cleaning bias power supply and a transfer portion so that a potential difference between the belt-like image carrier and the transfer roll becomes a value suitable for cleaning.

Besides, according to another aspect of the present invention, in the foregoing image forming apparatus, the resistance value of the resistor is set so that an optimum cleaning bias can always be applied against a change of the system resistance of the transfer portion.

According to the present invention, at the time of cleaning the transfer roll, both the electrostatic adhesion force and the mechanical adhesion force of the charged colorant to the surface of the belt-like image carrier are set larger than the electrostatic adhesion force and the mechanical adhesion force of the charged colorant to the surface of the transfer roll. Thus, the charged colorant adhered to the surface of the transfer roll can be certainly shifted from the surface of the transfer roll to the surface of the belt-like image carrier by both the electrostatic adhesion force and the mechanical adhesion force, it becomes possible to finely clean the transfer roll at all times, and an excellent cleaning property of the transfer roll can be assured without using a specific cleaning part.

Besides, according the present invention, in the foregoing image forming apparatus, the part which sets the electrostatic adhesion force of the charged colorant to the surface of the belt-like image carrier larger than the electrostatic adhesion force of the charged colorant to the surface of the transfer roll includes the part which applies the cleaning bias voltage having the polarity opposite to the transfer bias voltage to at least one of the backup roll and the transfer roll. Thus, by setting the cleaning bias voltage applied to at least one of the backup roll and the transfer roll, the electrostatic adhesion force of the charged colorant to the surface of the belt-like image carrier can be easily and certainly set larger than the electrostatic adhesion force of the charged colorant to the surface of the transfer roll.

Besides, according to the present invention, in the foregoing image forming apparatus, the part which sets the mechanical adhesion force of the charged colorant to the surface of the belt-like image carrier larger than the mechanical adhesion force of the charged colorant to the surface of the transfer roll includes the part which sets the surface energy of the belt-like image carrier larger than the surface energy of the transfer roll. Thus, by suitably setting the surface energy of the belt-like image carrier and the transfer roll, the mechanical adhesion force of the charged colorant to the surface of the belt-like image carrier can be easily and certainly set larger than the mechanical adhesion force of the charged colorant to the surface of the transfer roll.

Besides, according to the present invention, the image forming apparatus includes the belt-like image carrier which holds the visible image with the charged colorant and is circularly moved, the transfer roll which is disposed at the front surface of the image carrier to be brought into press contact through the recording medium and collectively transfers the visible image on the image carrier onto the recording medium, the backup roll which is disposed opposite to the transfer roll to be brought into press contact with the rear surface of the belt-like image carrier and forms the predetermined width transfer nip region to the transfer roll, and the transfer bias application part which applies the transfer bias voltage to at least one of the backup roll and the transfer roll, in which the cleaning bias voltage having the polarity opposite to the transfer bias voltage is applied to at least one of the backup roll and the transfer roll, and the output value of the cleaning bias voltage is controlled so that the potential difference between the belt-like image carrier and the transfer roll becomes optimum for cleaning. Thus, even in the case where an environmental variation or a change with time occurs, the output value of the cleaning bias voltage can be maintained so that the potential difference between the belt-like image carrier and the transfer roll becomes optimum for cleaning, and it becomes possible to finely clean the transfer part at all times.

Besides, according to the present invention, the image forming apparatus is constructed such that the cleaning bias voltage having the polarity opposite to the transfer bias voltage is applied to at least one of the backup roll and the transfer roll, and the output value of the cleaning bias voltage is controlled according to the system resistance between the backup roll and the transfer roll. Thus, by actually measuring the system resistance between the backup roll and the transfer roll and controlling the output value of the cleaning bias voltage according to the measurement value of the system resistance, even in the case where an environmental variation or a change with time occurs, the output value of the cleaning bias voltage can be maintained so that the potential difference between the belt-like image carrier and the transfer roll becomes optimum for cleaning, and it becomes possible to finely clean the transfer part at all times.

Besides, according to the present invention, the image forming apparatus is constructed such that the cleaning bias voltage having the polarity opposite to the transfer bias voltage is applied to at least one of the backup roll and the transfer roll, and the output value of the cleaning bias voltage is controlled according to the environmental variation. Thus, even in the case where an environment such as temperature or humidity is changed, the output value of the cleaning bias voltage can be maintained so that the potential difference between the belt-like image carrier and the transfer roll becomes optimum for cleaning, and it becomes possible to finely clean the transfer part at all times.

Besides, according to the present invention, the image forming apparatus is constructed such that the cleaning bias voltage having the polarity opposite to the transfer bias voltage is applied to at least one of the backup roll and the transfer roll, and the output value of the cleaning bias voltage is controlled according to the use history of the image forming apparatus. Thus, even in the case where the system resistance of the transfer part is changed with the passage of time, the output value of the cleaning bias voltage can be maintained so that the potential difference between the belt-like image carrier and the transfer roll becomes optimum for cleaning, and it becomes possible to finely clean the transfer part at all times.

Besides, according to the present invention, the image forming apparatus is constructed such that the cleaning bias voltage having the polarity opposite to the transfer bias voltage is applied to at least one of the backup roll and the transfer roll, and the resistor of the predetermined value corresponding to the system resistance between the backup roll and the transfer roll is provided between the cleaning bias power supply and the transfer portion so that the potential difference between the belt-like image carrier and the transfer roll becomes the value suitable for cleaning. Thus, by the simple structure that the resistor of the predetermined value corresponding to the system resistance between the backup roll and the transfer roll is provided between the cleaning bias power supply and the transfer portion, the potential difference between the belt-like image carrier and the transfer roll can be made the value suitable for cleaning, and even in the case where an environmental variation or a change with time occurs, it becomes possible to finely clean the transfer part at all times.

Besides, according to the present invention, in the foregoing image forming apparatus, the resistance value of the resistor is set so that the optimum cleaning bias can always be applied against the change of the system resistance of the transfer portion. Thus, even in the case where the environmental variation or the change with time occurs, the output value of the cleaning bias voltage can be maintained so that the potential difference between the belt-like image carrier and the transfer roll becomes optimum for cleaning, and it becomes possible to finely clean the transfer part at all times.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Preferred embodiments of the present invention will be described below with reference to the drawings.

Embodiment 1

Figure 2:
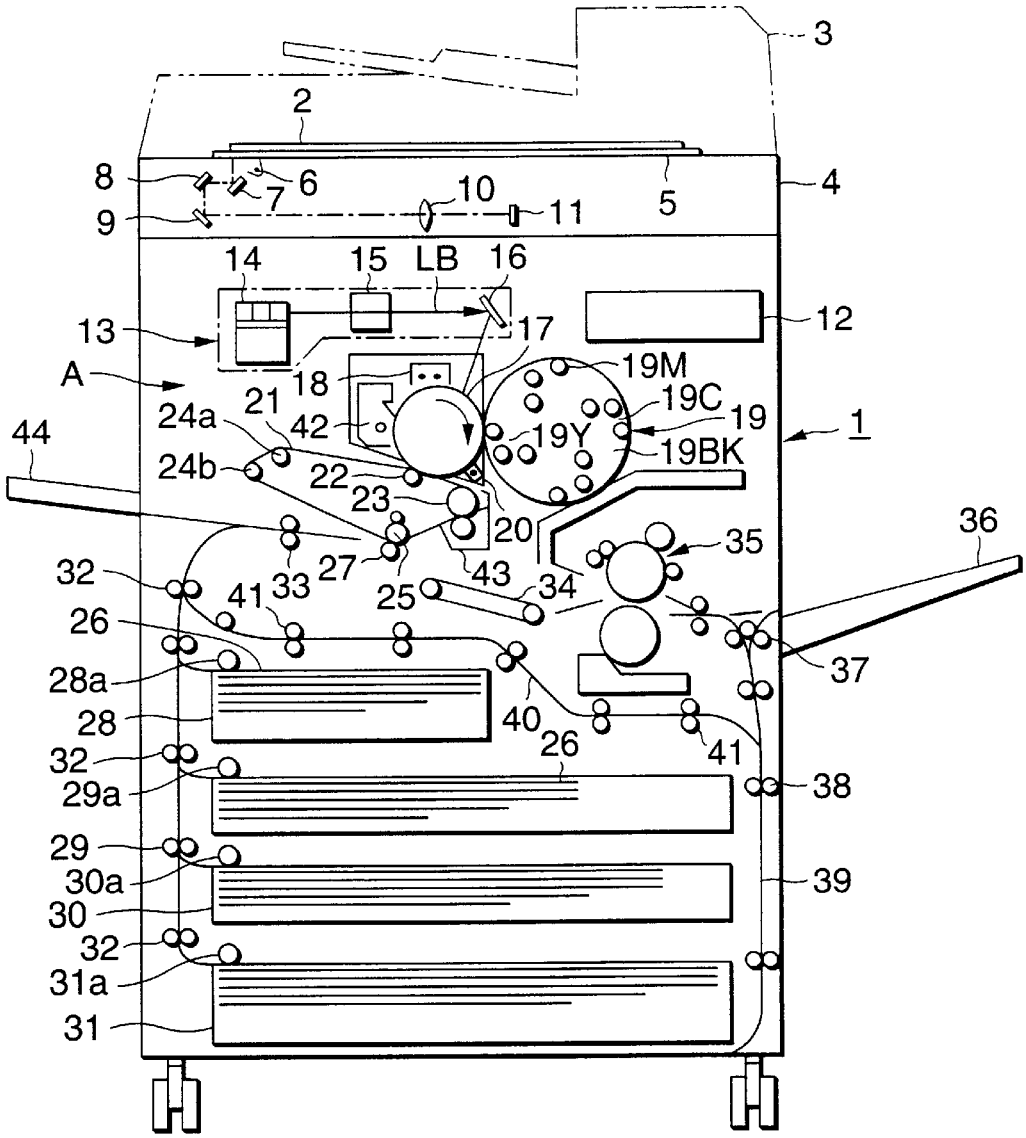
FIG. 2 is a structural view showing the color electrophotographic copying machine as the image forming apparatus according to the embodiment 1 of the present invention.

FIG. 2 shows a color electrophotographic copying machine as an image forming apparatus according to embodiment 1 of the present invention.

In FIG. 2, reference numeral 1 designates a main body of a color electrophotographic copying machine. An automatic document conveying device 3 for automatically conveying an original document 2 in a state where the documents are separated from each other, and a document reading device 4 for reading an image of the original document 2 conveyed by the automatic document conveying device 3 are disposed on an upper portion of the color electrophotographic copying machine main body 1. In this document reading device 4, the original document 2 put on a platen glass 5 is illuminated by a light source 6, a reflected light image from the original document 2 is scanned and exposed onto an image reading element 11 made of CCDs or the like through a reducing optical system constituted by a full rate mirror 7, half rate mirrors 8, 9, and an imaging lens 10, and a colorant reflected light image of the original document 2 is read by this image reading element 11 at a predetermined dot density (for example, 16 dots/mm).

The colorant reflected light image of the original document 2 read by the foregoing document reading device 4 is sent as, for example, original document reflectivity data of three colors of red (R), green (G) and blue (B) (each has 8 bits), to an image processing device 12. In this image processing device 12, predetermined image processing, such as shading correction, position shift correction, brightness/color space conversion, gamma correction, frame erasure, or color/movement edition, is carried out to the reflectivity data of the original document 2.

The image data subjected to the predetermined image processing by the image processing device 12 as described above are sent, as original document colorant gradation data of four colors of yellow (Y), magenta (M), cyan (C), and black (BK)(each has 8 bits), to a ROS 13 (Raster Output Scanner). In this ROS 13, image exposure by laser light is carried out in accordance with the original document colorant gradation data.

An image forming part A capable of forming plural toner images with difference colors is provided in the inside of the color electrophotographic copying machine main body 1. This image forming part A is mainly constructed by a photoreceptor drum 17 as an image carrier on which an electrostatic latent image is formed, and a rotary system developing device 19 as a developing part capable of forming plural toner images having different colors by developing the electrostatic latent images formed on the photoreceptor drum 17.

As shown in FIG. 2, in the ROS 13, a not-shown semiconductor laser is modulated in accordance with the document reproduction colorant gradation data, and a laser beam LB is emitted from the semiconductor laser in accordance with the gradation data. The laser beam LB emitted from the semiconductor laser is deflected and scanned by a rotating polygon mirror 14, and is scanned and exposed onto the photoreceptor drum 17 as the image carrier through a f θ lens 15 and a reflecting mirror 16.

The photoreceptor drum 17 onto which the laser beam LB is scanned and exposed by the ROS 13 is driven to rotate at a predetermined speed in the direction of an arrow by a not-shown driving part. After the surface of the photoreceptor drum 17 is charged to a predetermined polarity (for example, minus polarity) and potential by a screen corotron 18 for primary charging, the laser beam LB is scanned and exposed in accordance with the document reproduction colorant gradation data, so that an electrostatic latent image is formed. The electrostatic latent image formed on the photoreceptor drum 17 is reversal developed by the rotary system developing device 19 equipped with developing units 19Y, 19M, 19C, and 19BK of four colors of yellow (Y), magenta (M), cyan (C), and black (BK) and by, for example, toner (charged colorant) charged to the minus polarity of the same polarity as the charged polarity of the photoreceptor drum 17, and becomes a toner image of predetermined color. Incidentally, the toner image formed on the photoreceptor drum 17 receives charging of the minus polarity by a pre-transfer charging unit 20 as needed, and the amount of electric charge is adjusted.

The toner images of the respective colors formed on the photoreceptor drum 17 are transferred so as to overlap with each other by a primary transfer roll 22 as a first transfer part onto an intermediate transfer belt 21 as an intermediate transfer body disposed at an under portion of the photoreceptor drum 17. This intermediate transfer belt 21 is supported by a driving roll 23, a follower roll 24*a*, a tension roll 24*b*, and a backup roll 25 as an opposite roll constituting part of a secondary transfer part, in such a manner that the intermediate transfer belt can be rotated in the arrow direction at the same moving speed as a peripheral speed of the photoreceptor drum 17.

In accordance with the color of an image to be formed, toner images of all of or part of four colors of yellow (Y), magenta (M), cyan(C), and black (BK) formed on the photoreceptor drum 17 are sequentially transferred onto the intermediate transfer belt 21 by the primary transfer roll 22 in the state where they overlap with each other. The toner images transferred onto the intermediate transfer belt 21 are transferred onto a recording sheet 26 as a recording medium conveyed to a secondary transfer position at predetermined timing by a pressing force and an electrostatic attracting force of the backup roll 25 for supporting the intermediate transfer belt 21 and a secondary transfer roll 27 which constitutes part of a secondary transfer part and comes in press contact with the backup roll 25. As shown in FIG. 2, the recording sheet 26 of a predetermined size is fed by feed rolls 28*a*, 29*a*, 30*a*, and 31*a* from one of paper feed cassettes 28, 29, 30 and 31 as plural recording medium accommodating members disposed at a lower portion in the color electrophotographic copying machine main body 1. The fed recording sheet 26 is conveyed to the secondary transfer position of the intermediate transfer belt 21 at the predetermined timing by plural conveying rolls 32 and a registration roll 33. Then, as described above, by the backup roll 25 and the secondary transfer roll 27 as the secondary transfer part, the toner images of the predetermined colors are collectively transferred onto the recording sheet 26 from the intermediate transfer belt 21.

After the recording sheet 26 onto which the toner images of the predetermined colors were transferred from the intermediate transfer belt 21 is separated from the intermediate transfer belt 21, it is conveyed to a fixing device 35 by a conveying belt 34. The toner images are fixed onto the recording sheet 26 by this fixing device 35 and with the heat and pressure, and in the case of one-sided copying, the sheet is directly discharged onto a paper discharge tray 36, and the copying step of a color image is ended.

On the other hand, in the case of two-sided copying, the recording sheet 26 on a first surface (front surface) of which the color image was formed is not directly discharged onto the paper discharge tray 36, but the conveying direction is changed downward by a not-shown inverting gate, and the sheet is once conveyed to an inverting passage 39 by a tri-roll 37 in which three rolls are in press contact with each other and an inverting roll 38. Then, the recording sheet 26 is conveyed to a passage 40 for two-sided copying by the inverting roll 38 which is reversely rotated, and is once conveyed to the registration roll 33 by a conveying roll 41 provided on the passage 40 for two-sided copying and is stopped. The conveyance of the recording sheet 26 is started again by the registration roll 33 in synchronization with the toner images on the intermediate transfer belt 21. After transfer and fixing steps of the toner images are carried out to the second surface (rear surface) of the recording sheet 26, the sheet is discharged onto the discharge tray 36.

Incidentally, in FIG. 2, reference numeral 42 designates a cleaning device for removing a remaining toner, paper powder, or the like from the surface of the photoreceptor drum 17 after the transfer step is ended; 43, an intermediate transfer belt cleaner for cleaning the intermediate transfer belt 21; and 44, a manual paper feed tray.

Figure 1:
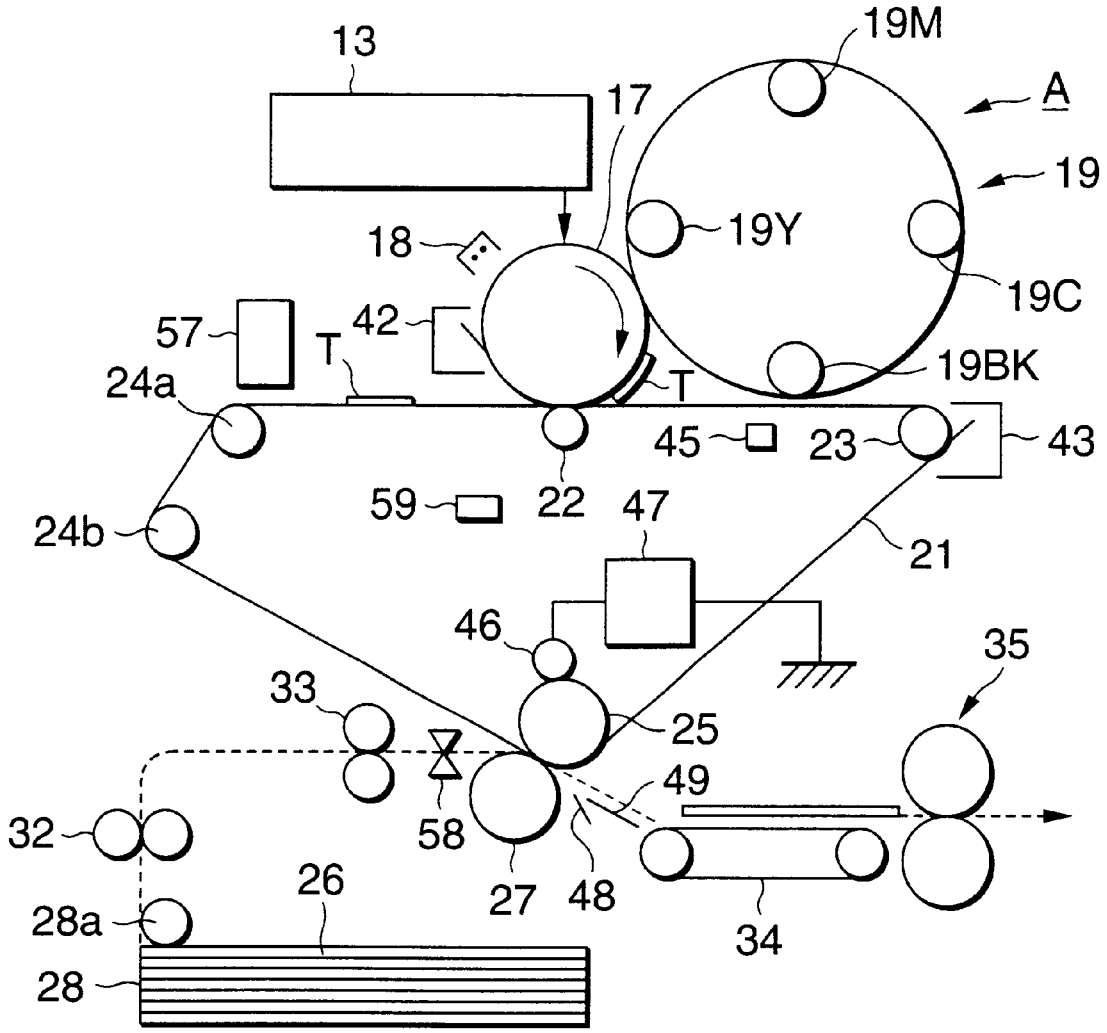
FIG. 1 is a structural view showing an image forming part of a color electrophotographic copying machine as an image forming apparatus according to embodiment 1 of the present invention.

FIG. 1 is a structural view showing an image forming part A of the color electrophotographic copying machine.

In this color electrophotographic copying machine, as described above, after the surface of the photoreceptor drum 17 is uniformly charged to a predetermined potential by the screen corotron 18 for primary charging, an image corresponding to a predetermined color is exposed onto the surface of the photoreceptor drum 17 by the ROS 13, and an electrostatic latent image is formed. The electrostatic latent image formed on the surface of the photoreceptor drum 17 correspondingly to each color is developed by the developing unit 19Y, 19M, 19C or l9BK of the corresponding color, and a toner image T of the predetermined color is formed on the surface of the photoreceptor drum 17.

For example, if the electrostatic latent image formed on the photoreceptor drum 17 corresponds to yellow, this electrostatic latent image is developed by the developing unit 19Y for yellow, and the yellow toner image T is formed on the photoreceptor drum 17. Besides, with respect to the other colors of magenta, cyan, and black as well, the toner images T of the corresponding colors are sequentially formed on the photoreceptor drum 17 by a similar process.

The toner images T of the respective colors sequentially formed on the photoreceptor drum 17 are transferred onto the surface of the intermediate transfer belt 21 from the photoreceptor drum 17 at the primary transfer position where the photoreceptor drum 17 comes in contact with the intermediate transfer belt 21. At this primary transfer position, the semi-conductive bias roll 22 for the primary transfer is disposed at the rear surface of the intermediate transfer belt 21, and the intermediate transfer belt 21 is brought into contact with the surface of the photoreceptor drum 17 by the bias roll 22 for the primary transfer. A voltage having a polarity opposite to the charged polarity of the toner is applied to the bias roll 22 for the primary transfer, and the toner images T formed on the photoreceptor drum 17 are transferred onto the intermediate transfer belt 21 by the pressing force and the electrostatic attracting force.

In the case where an image of a single color is formed, the toner image T of the predetermined color which has been primarily transferred onto the intermediate transfer belt 21 is immediately secondarily transferred onto the recording sheet 26. However, in the case where a color image obtained by overlapping the toner images T of plural colors is formed, the formation of the toner image T of a predetermined color onto the photoreceptor drum 17, and the step of primary transfer of the toner image T onto the intermediate transfer belt 21 are repeated plural times of the number of predetermined colors.

For example, in the case of forming an image of a full color in which the toner images T of four colors of yellow (Y), magenta (M), cyan (C) and black (BK) overlap with each other, the toner images T of the respective colors of yellow (Y), magenta (M), cyan (C) and black (BK) are sequentially formed on the photoreceptor drum 17 every rotation thereof, and the toner images of these four colors are primarily transferred onto the intermediate transfer belt 21 in the state where they overlap with each other.

At that time, the intermediate transfer belt 21 rotates in a period synchronous with the photoreceptor drum 17 while holding the unfixed toner image T of yellow first primarily transferred. At a predetermined position determined by a position detection sensor 45, every rotation thereof, the unfixed toner images T of magenta, cyan, and black are transferred onto the intermediate transfer belt 21 in the state where they sequentially overlap with the yellow unfixed toner image T.

The unfixed toner images T primarily transferred onto the intermediate transfer belt 21 in this way are conveyed to the secondary transfer position facing to the conveying passage of the recording sheet 26 with the rotation of the intermediate transfer belt 21.

As described above, the recording sheet 26 is fed from the predetermined paper feed cassette 28, 29, 30 or 31 by the feed rolls 28*a*, 29*a*, 30*a* and 31*a*, is conveyed to the registration roll 33 by the conveying roll 32, and is fed to a nip portion between the secondary transfer roll 27 and the intermediate transfer belt 21 by the registration roll 33 at predetermined timing.

At the rear surface side of the intermediate transfer belt 21 at the secondary transfer position, the backup roll 25 which is a counter electrode of the secondary transfer roll 27 is disposed. At the secondary transfer position, the semi-conductive secondary transfer roll 27 comes in press contact with the intermediate transfer belt 21 at the predetermined timing, and by applying the voltage having the polarity opposite to the charged polarity of the toner to the backup roll 25, the unfixed toner images T transferred onto the intermediate transfer belt 21 are electrostatically secondarily transferred onto the recording sheet 26 at the secondary transfer position.

This embodiment is structured such that, as shown in FIG. 1, the voltage having the same polarity as the charged polarity of the toner is not directly applied to the secondary transfer roll 27, but the voltage having the same polarity as the charged polarity of the toner is applied to the backup roll 25, which comes in press contact with the secondary transfer roll 27 through the intermediate transfer belt 21, by a bias roll 46 from a high voltage power source 47 for transfer bias as a transfer bias voltage application part. However, such a structure may be naturally adopted that the voltage having the same polarity as the charged polarity of the toner is directly applied to the secondary transfer roll 27.

The recording sheet 26 onto which the unfixed toner images were transferred is separated from the intermediate transfer belt 21, is sent to the fixing device 35 by an electrode member 48, a guide plate 49 and a conveying belt 34 disposed at the downstream side of the secondary transfer portion, and a fixing treatment of the unfixed toner images T is carried out.

On the other hand, with respect to the intermediate transfer belt 21 after the secondary transfer of the unfixed toner images T is ended, the remaining toner is removed by the cleaner 44 for the intermediate transfer belt.

The intermediate transfer belt 21 is made of a synthetic resin, such as polyimide, polycarbonate, polyester, or polypropylene, or various kinds of rubber, containing a suitable amount of antistatic agent such as carbon black, and is formed so that its volume resistivity becomes $10^6$ to $10^{14}\Omega\cdot$cm. The thickness of the intermediate transfer belt 21 is set to, for example, 0.1 mm. The peripheral length of the intermediate transfer belt 21 is set to integer times (for example, 3 times) as long as the peripheral length of the photoreceptor drum 17.

The secondary transfer roll 27 and the intermediate transfer belt cleaner 44 are disposed so that they can be brought into contact with and be separated from the intermediate transfer belt 21. In the case where a color image is formed, until the unfixed toner image T of the final color is primarily transferred onto the intermediate transfer belt 21, at least the intermediate transfer belt cleaner 44 is separated from the intermediate transfer belt 21.

Moreover, the secondary transfer roll 27 includes a surface layer made of a tube of urethane rubber in which carbon is dispersed, and an inner layer made of foamed urethane rubber in which carbon is dispersed. The surface of the secondary transfer roll 27 is coated with fluorine. The secondary transfer roll 27 is set such that its volume resistivity is $10^3$ to $10^{10}\Omega\cdot$cm, a roll diameter is 28 ϕmm, and hardness is, for example, 30° (Askar C).

On the other hand, the backup roll 25 includes a surface layer made of a tube of blend rubber of EPDM and NBR in which carbon is dispersed, and an inner layer made of rubber of EPDM. The backup roll is set such that its surface resistivity is $10^7$ to $10^{10}\Omega/\square$, a roll diameter is 28 ϕmm, and hardness is 70° (Askar C).

As the electrode member 48 disposed at the downstream side of the nip portion of the secondary transfer position, a metal plate is preferable as a conductive plate-like member. In this embodiment, a stainless steel plate with a thickness of 0.5 mm is used, and a needle-like portion is formed at the side of the recording sheet 26. Further, the tip of the electrode member 48 at the side of the secondary transfer region is disposed at the side of the secondary transfer roll 27 by 1 mm from the line of the nip portion between the backup roll 25 and the secondary transfer roll 27, and is apart from the outlet of the nip portion by 7 mm.

Further, the color electrophotographic copying machine of this embodiment 1 is constructed such that in the case where a toner image transferred onto a non-image area of the intermediate transfer body is positioned on the intermediate transfer body other than the area corresponding to the recording medium, the second transfer part is provided with a transfer bias voltage application control part for making control to apply a reverse transfer bias voltage (cleaning bias voltage) having the polarity opposite to the transfer bias voltage to at least the area other than the recording medium.

Figure 3:
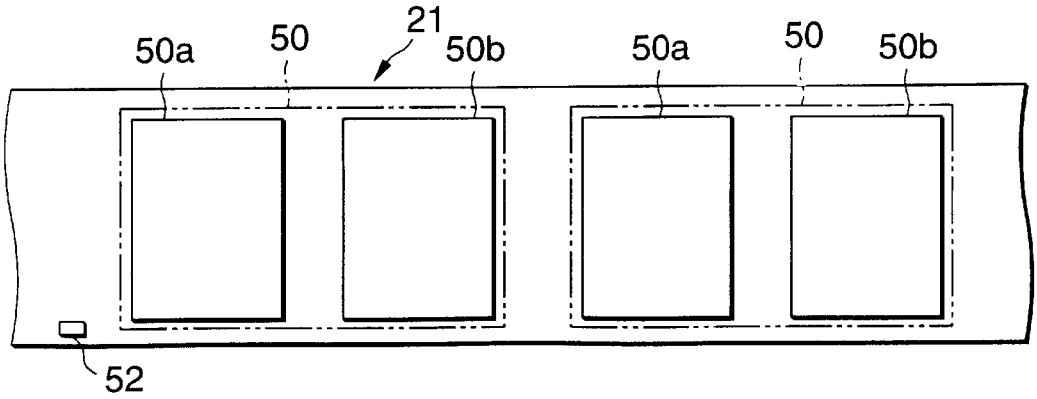
FIG. 3 is an explanatory view showing an image area and a non-image area of an intermediate transfer belt.

That is, in the color electrophotographic copying machine of this embodiment 1, as shown in FIG. 3, the surface of the intermediate transfer belt 21 is previously divided into an image area 50 and a non-image area 51. The image area 50 is set correspondingly to the recording sheet 26 of the maximum size (for example, A3 size) which can be copied by the color electrophotographic copying machine. Two surfaces of the image areas 50 corresponding to the A3 size recording sheet 26 are set on the surface of the intermediate transfer belt 21, and a portion between these image areas 50 is the non-image area 51. The intermediate transfer belt 21 is constructed such that, as shown in FIG. 1, a mark 52 provided at the reference position is detected by the position detection sensor 45, so that the positions of the image area 50 and the nonimage area 51 are recognized, and the toner image T corresponding to the original document 2 is transferred onto the image area 50. Besides, in the color electrophotographic copying machine, when an image is formed on the recording sheet 26 which has a size not larger than half of the A3 size, for example, A4 size, the image area 50 is divided into two areas 50*a* and 50*b* (for example, an area corresponding to A4 size), and the toner image of the original document 2 can be transferred also onto the respective areas 50*a* and 50*b* of the image area 50.

Besides, with the advance of picture quality, in order to assure the picture quality of the color image, the color electrophotographic copying machine is constructed such that a patch for process control and a patch for registration control are transferred onto the intermediate transfer body before the image forming operation or at the timing of a paper feed interval of the recording medium, the patch for the process control and the patch for the registration control are detected, and on the basis of the detection result, the image forming operation is controlled.

Figure 4:
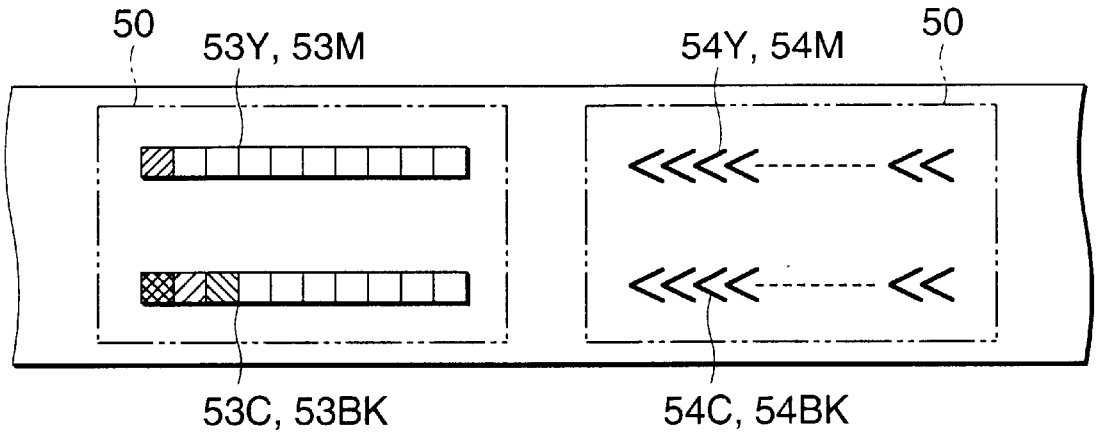
FIG. 4 is an explanatory view showing a patch for process control and a patch for registration control which are transferred onto an intermediate transfer belt.

That is, in the color electrophotographic copying machine, when a power supply switch of the copying machine is turned on, when a predetermined number of copies are taken, or at the time of a setup operation after a copy button for starting a copying operation is pressed and before the copying operation is actually started, as shown in FIG. 4, in the image area 50 of the intermediate transfer belt 21, plural patches 53Y, 53M, 53C, and 53BK for process control of the respective colors of yellow (Y), magenta (M), cyan (C), and black (BK) are formed at different densities, and sideways V-shaped patches 54Y, 54M, 54C, and 54BK for registration control of the respective colors of yellow (Y), magenta (M), cyan (C), and black (BK) are formed at a predetermined pitch.

Figure 5:
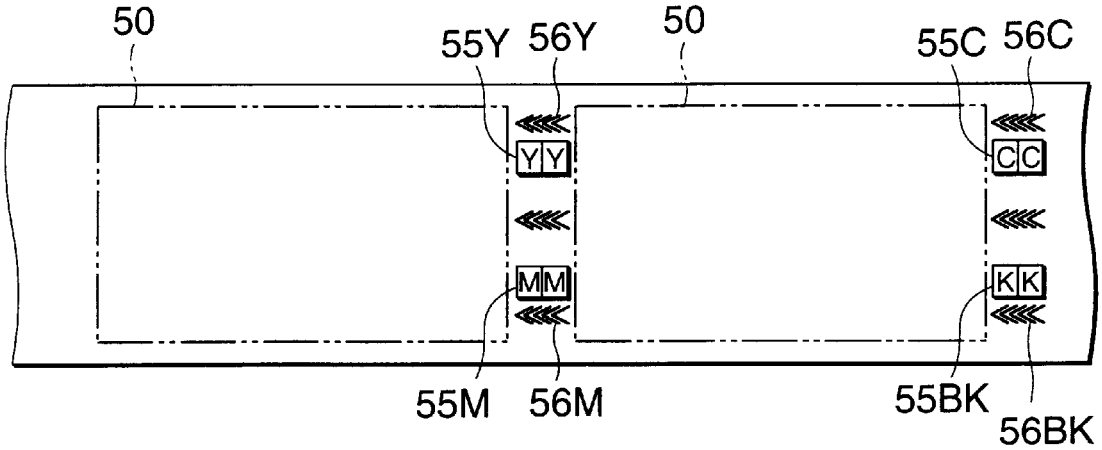
FIG. 5 is an explanatory view showing a patch for process control and a patch for registration control which are transferred onto an intermediate transfer belt.

Besides, in the color electrophotographic copying machine, as shown in FIG. 5, in the non-image area 50 corresponding to a paper feed interval of the recording sheet 26 on the intermediate transfer belt 21, patches 55Y, 55M, 55C, and 55BK for process control of the respective colors of yellow (Y), magenta (M), cyan (C), and black (BK) are formed at two kinds of densities of 60% and 20%, and sideways V-shaped patches 56Y, 56M, 56C, and 56BK for registration control of the respective colors of yellow (Y), magenta (M), cyan (C), and black (BK) are formed at a predetermined pitch.

The patches 53Y, 53M, 53C, 53BK, 54Y, 54M, 54C, and 54BK for the process control formed on the intermediate transfer belt 21 and the patches 55Y, 55M, 55C, 55BK, 56Y, 56M, 56C, and 56BK for the registration control are detected, as shown in FIG. 1, by an optical sensor 57 disposed above the follower roll 24*a*.

Moreover, the color electrophotographic copying machine is constructed such that in the case where at least part of the toner image transferred onto the non-image area 51 and the image area 50 of the intermediate transfer belt 21 is positioned on the intermediate transfer belt 21 other than an area corresponding to the recording sheet 26, the secondary transfer part is provided with a CPU 60 as a transfer bias voltage application control part for making control to apply a reverse transfer bias voltage (cleaning bias voltage) having a polarity opposite to a transfer bias voltage to at least the area other than the recording sheet 26.

Besides, in the color electrophotographic copying machine, as shown in FIG. 1, a sheet detection sensor 58 for detecting the recording sheet 26 is disposed at the upstream side of the secondary transfer position. This sheet detection sensor 58 detects the tip end, rear end, or the like of the recording sheet 26 conveyed to the secondary transfer position where it comes in contact with the intermediate transfer belt 21.

Further, in the color electrophotographic copying machine, a humidity sensor 59 for detecting humidity and a temperature sensor 66 are provided in the inside of the intermediate transfer belt 21.

Figure 6:
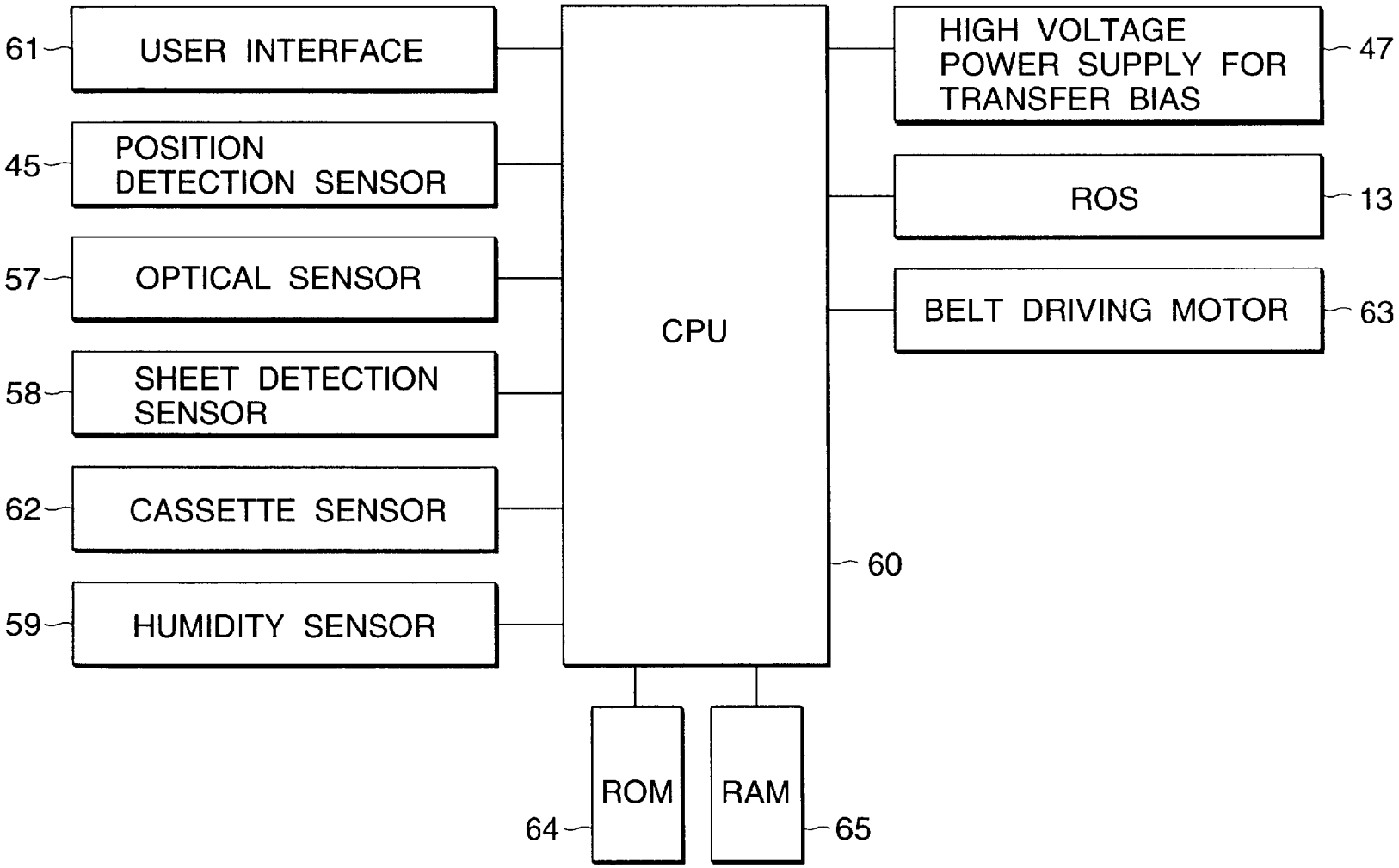
FIG. 6 is a block diagram showing a control circuit of the color electrophotographic copying machine as the image forming apparatus according to the embodiment 1 of the present invention.

FIG. 6 is a block diagram showing a control circuit of the color electrophotographic copying machine.

In FIG. 6, reference numeral 60 designates a CPU which controls an image forming operation of the color electrophotographic copying machine and functions also as a transfer bias voltage application control part; 61, a user interface which specifies the number of copied sheets, copying magnification, size of the recording sheet 26, and the like; 45, a position detection sensor for detecting the mark 52 provided on the intermediate transfer belt 21; 57, an optical sensor for detecting the patches 53Y, 53M, 53C, 53BK, 54Y, 54M, 54C, and 54BK for the process control transferred onto the intermediate transfer belt 21, and the patches 55Y, 55M, 55C, 55BK, 56Y, 56M, 56C, and 56BK for the registration control; 58, a sheet detection sensor disposed in front of the secondary transfer position; 62, a cassette sensor for detecting the size of the recording sheet 26 accommodated in the sheet feed cassette 28, 29, 30 or 31 by a size detection portion provided at the sheet feed cassette 28, 29, 30 or 31; 59, a humidity sensor for detecting the humidity of the inside of the color electrophotographic copying machine main body 1; 47, a high voltage power supply for transfer bias voltage as a transfer bias voltage application part for applying a transfer bias voltage to the backup roll 27 as the secondary transfer part; 13, a ROS which performs image exposure corresponding to an image of the original document 2 onto the photoreceptor drum 17 and performs image exposure to form the patches 53Y, 53M, 53C, 53BK, 54Y, 54M, 54C, and 54BK for the process control, and the patches 55Y, 55M, 55C, 55BK, 56Y, 56M, 56C, and 56BK for the registration control; 63, a belt driving motor for rotating and driving the intermediate transfer belt 21; 64, a ROM storing a program with which the CPU 60 performs the image forming operation of the color electrophotographic copying machine and the transfer bias voltage application control operation; and 65, a RAM for storing data or the like with which the CPU 60 makes the control operation.

The color electrophotographic copying machine of the embodiment 1 is designed such that at the time of cleaning the transfer roll, both the electrostatic adhesion force and the mechanical adhesion force of the charged colorant to the surface of the belt-like image carrier become larger than the electrostatic adhesion force and the mechanical adhesion force of the charged colorant to the surface of the transfer roll.

Besides, this embodiment 1 is constructed such that the part which sets the electrostatic adhesion force of the charged colorant to the surface of the belt-like image carrier larger than the electrostatic adhesion force of the charged colorant to the surface of the transfer roll includes the part which applies the cleaning bias voltage having the polarity opposite to the transfer bias voltage to at least one of the backup roll and the transfer roll.

Further, this embodiment 1 is constructed such that the part which sets the mechanical adhesion force of the charged colorant to the surface of the belt-like image carrier larger than the mechanical adhesion force of the charged colorant to the surface of the transfer roll includes the part which sets the surface energy of the belt-like image carrier larger than the surface energy of the transfer roll.

That is, in the color electrophotographic copying machine of the embodiment 1, in order to set the surface energy of the intermediate transfer belt 21 larger than the surface energy of the secondary transfer roll 27, the contact angle of water on the surface of the secondary transfer roll 27 is set larger than the contact angle of water on the surface of the intermediate transfer belt 21.

Figure 7:
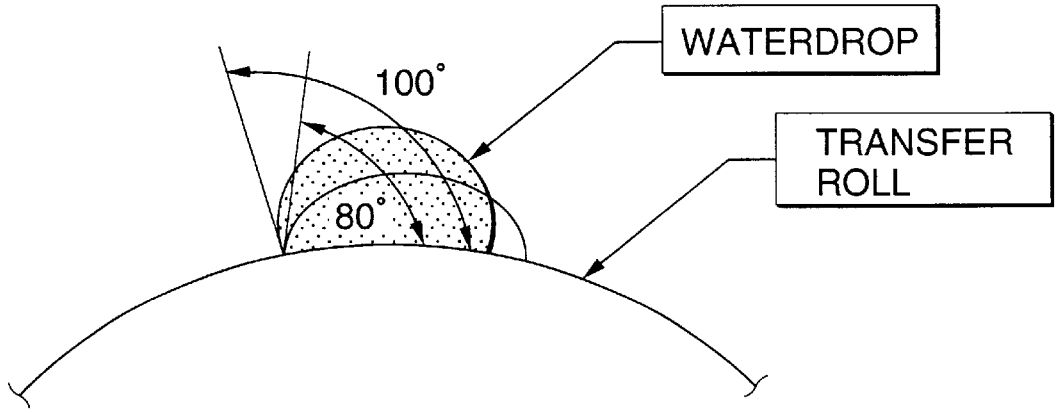
FIG. 7 is an explanatory view showing a contact angle of water on the surface of a secondary transfer roll.

Specifically, the surface roughness Rz of the secondary transfer roll 27 to which fluorine coating is applied is set by surface polishing or the like such that Rz <5 $\mu$m is established. At this time, as shown in FIG. 7, the contact angle of water on the surface of the secondary transfer roll 27 is controlled to be within the range of 85° to 100°. At this time, the contact angle of water on the surface of the intermediate transfer belt 21 is within the range of 70° to 80°, and the above relation is satisfied. Although the surface of the secondary transfer roll 27 is formed to be arc-shaped, since a waterdrop attached to the surface of the secondary transfer roll 27 is small, the surface of the secondary transfer roll 27 can be approximated to a plane.

Figure 8:
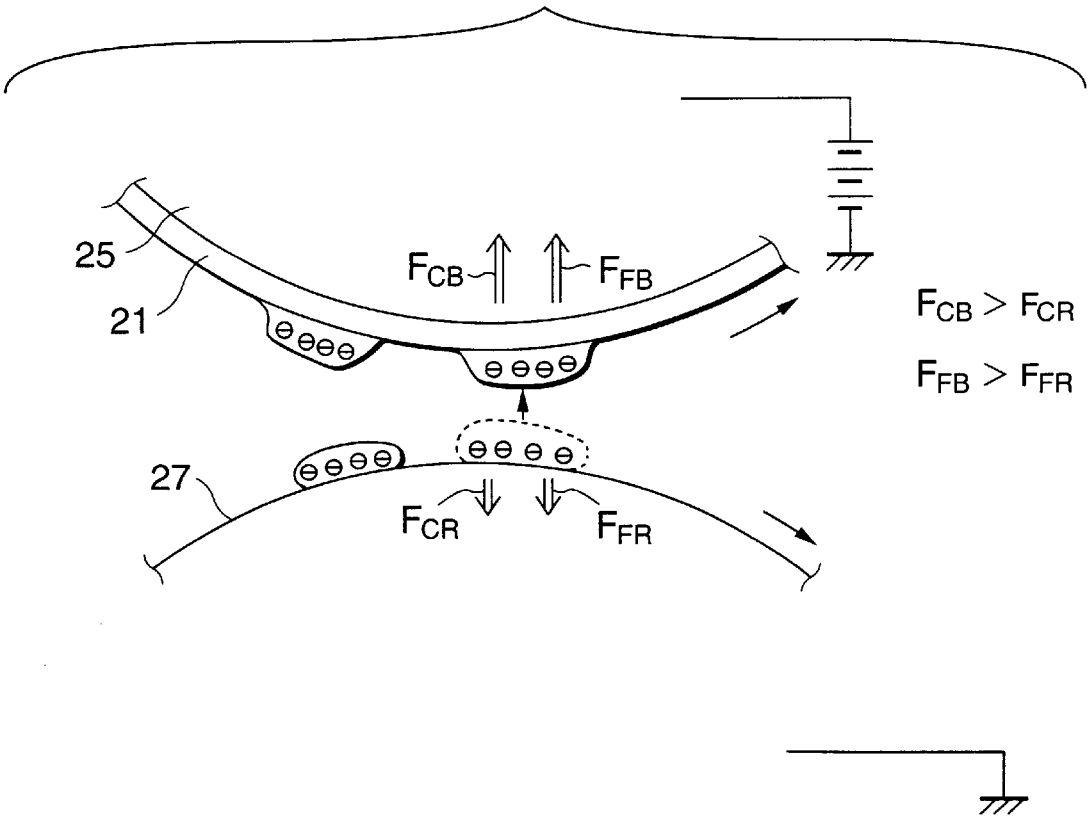
FIG. 8 is an explanatory view showing a mechanical adhesion force of toner to an intermediate transfer belt and a secondary transfer roll.

By doing so, as shown in FIG. 8, the mechanical adhesion force $F_{FR}$ of toner to the secondary transfer roll 27 is made lower than the mechanical adhesion force $F_{FB}$ of toner to the intermediate transfer belt 21, so that the toner becomes hard to shift from the intermediate transfer belt 21 to the secondary transfer roll 27.

The CPU 60 makes control so that a predetermined voltage value of cleaning bias is applied to the backup roll 25 through the bias roll 46 by the high voltage power supply 47 for transfer bias.

The cleaning bias voltage applied to the backup roll 25 is set such that at the time of cleaning the secondary transfer roll 27, the electrostatic adhesion force $F_{CB}$ of toner to the surface of the intermediate transfer belt 21 becomes larger than the electrostatic adhesion force $F_{CR}$ of toner to the surface of the secondary transfer roll 27.

In the foregoing structure, in the case of the color electrophotographic copying machine of the embodiment 1, the relation between the mechanical adhesion force of the toner to the surface of the transfer roll and the mechanical adhesion force of the toner to the surface of the image carrier with which the transfer roll comes in press contact is regulated in the manner described below, so that the transfer roll can be finely cleaned at all times.

Figure 9:
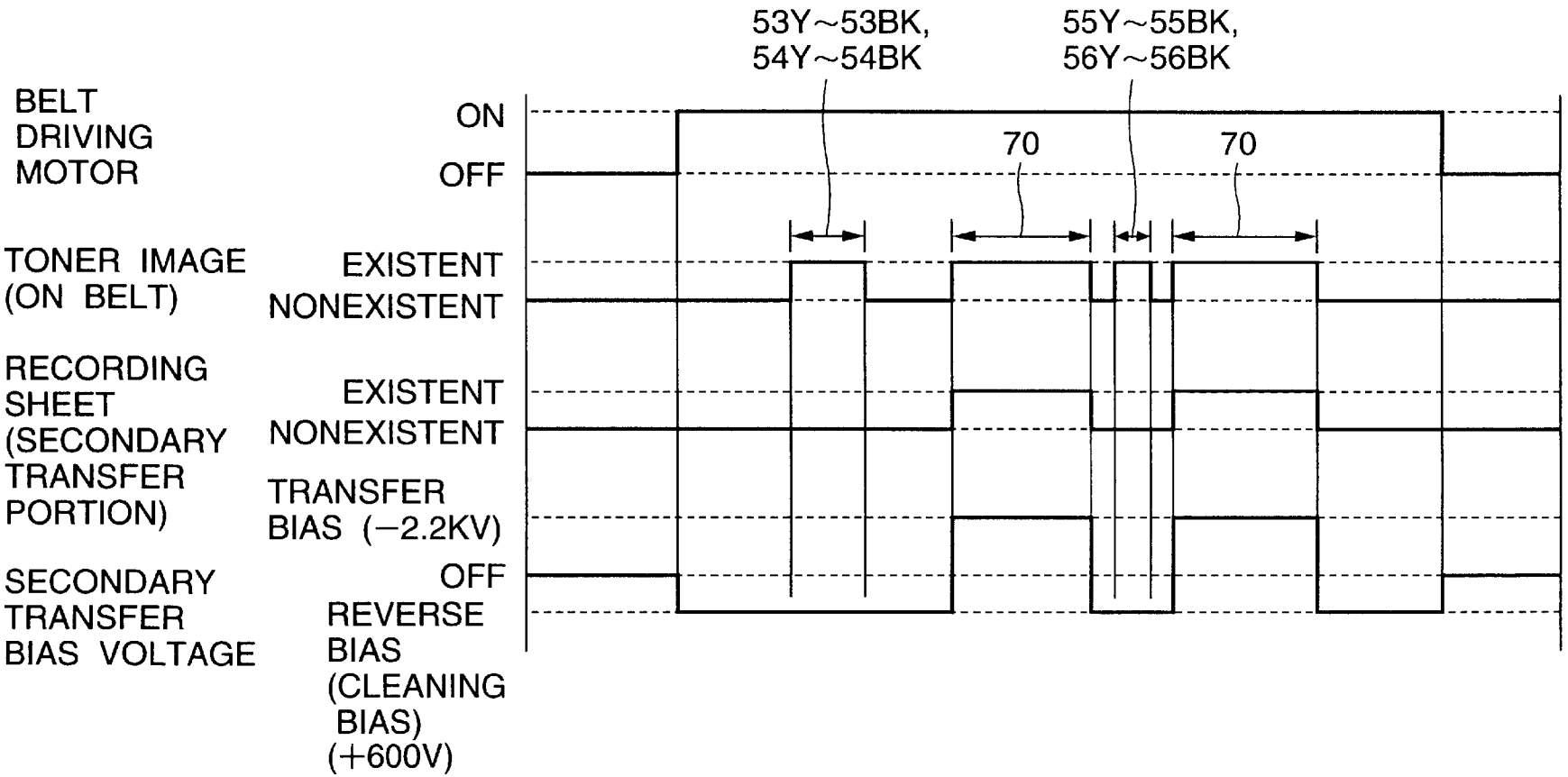
FIG. 9 is a timing chart showing an image forming operation of the color electrophotographic copying machine as the image forming apparatus according to the embodiment 1 of the present invention.

That is, as shown in FIG. 2, in the color electrophotographic copying machine of the embodiment 1, when the original document 2 is set at a predetermined position, the user interface 61 is operated to specify the number of sheets to be copied, copying magnification, size of the recording sheet 26, or the like, and the copy button is pressed, by the control of the CPU 60, the photoreceptor drum 17 is driven to rotate, and as shown in FIG. 9, the belt driving motor 63 for rotation driving the intermediate transfer belt 21 is turned ON, and the intermediate transfer belt 21 is driven to rotate. Besides, by the CPU 60 as the transfer bias voltage application control part, at the same time as the rotation of the intermediate transfer belt 21, the reverse transfer bias voltage (cleaning bias voltage) of, for example, +600 to 700 V is applied through the high voltage power supply 47 for the transfer bias voltage to the backup roll 25 of the secondary transfer part. Incidentally, the embodiment 1 is constructed such that while the belt driving motor 63 rotates, the secondary transfer roll 27 is put in the state where it remains being in press contact with the intermediate transfer belt 21.

Onto the image area 50 of the intermediate transfer belt 21, as shown in FIG. 4 and FIG. 9, at the setup operation after the copy button for starting the copying operation is pressed and before the copying operation is actually started, the plural patches 53Y, 53M, 53C and 53BK for the process control of the respective colors of yellow (Y), magenta (M), cyan (C), and black (BK) formed on the photoreceptor drum 17 are transferred at different densities, and the sideways V-shaped patches 54Y, 54M, 54C and 54BK for the registration control of the respective colors of yellow (Y), magenta (M), cyan (C), and black (BK) are transferred at a predetermined pitch. The patches 53Y, 53M, 53C and 53BK for the process control of the respective colors transferred onto the image area 50 of the intermediate transfer belt 21, and the sideways V-shaped patches 54Y, 54M, 54C and 54BK for the registration control of the respective colors are detected by the optical sensor 57 as shown in FIG. 1. The data of density and position of the patches for the process control and the patches for the registration control are sent to the CPU 60 as shown in FIG. 6. The CPU 60 judges whether the data of density and position of the patches for the process control and the patches for the registration control are within a predetermined range, and controls various parameters for image formation so that the data of density and position of the patches are placed within the predetermined range.

Besides, also when the patches 53Y, 53M, 53C and 53BK for the process control of the respective colors transferred onto the image area 50 of the intermediate transfer belt 21, and the patches 54Y, 54M, 54C and 54BK for the registration control of the respective colors pass through the secondary transfer position, the CPU 60 maintains the state, as shown in FIG. 9, where the reverse transfer bias voltage of, for example, +600 V, remains applied to the backup roll 25 through the high voltage power supply 47 for the transfer bias voltage. Thus, when the patches 53Y, 53M, 53C and 53BK for the process control of the respective colors transferred onto the image area 50 of the intermediate transfer belt 21, and the patches 54Y, 54M, 54C and 54BK for the registration control of the respective colors pass through the secondary transfer position, they are placed in the state where they remain transferred on the intermediate transfer belt 21 by the reverse transfer bias voltage applied to the backup roll 25, and are not transferred onto the secondary transfer roll 27 which is in press contact with the intermediate transfer belt 21. Incidentally, the patches 53Y, 53M, 53C and 53BK for the process control of the respective colors transferred onto the image area 50 of the intermediate transfer belt 21, and the patches 54Y, 54M, 54C and 54BK for the registration control of the respective colors are thereafter removed from the intermediate transfer belt 21 by the intermediate transfer belt cleaner 43.

Next, onto the image area 50 of the intermediate transfer belt 21 and the area corresponding to the paper feed interval of the recording sheet 26, as shown in FIG. 5 and FIG. 9, a toner image 70 corresponding to the image of the original document 2 formed on the photoreceptor drum 17 and the patches 55Y, 55M, 55C and 55BK for the process control of the respective colors of yellow (Y), magenta (M), cyan (C) and black (BK) are transferred at two kinds of densities, and the sideways V-shaped patches 56Y, 56M, 56C and 56BK for the registration control of the respective colors of yellow (Y), magenta (M), cyan (C) and black (BK) are transferred at the predetermined pitch.

At that time, in the case where a full color image is formed, the toner images of the respective colors of yellow (Y), magenta (M), cyan (C) and black (BK) are sequentially transferred onto the image area 50 of the intermediate transfer belt 21 every rotation of the photoreceptor drum 17. Besides, onto the area corresponding to the paper feed interval of the recording sheet 26, the patches 55Y, 55M, 55C and 55BK for the process control of the respective colors of yellow (Y), magenta (M), cyan (C) and black (BK) are transferred at two kinds of densities every rotation of the photoreceptor drum 17 as shown in FIG. 5, and the sideways V-shaped patches 56Y, 56M, 56C and 56BK for the registration control of the respective colors of yellow (Y), magenta (M), cyan (C) and black (BK) are transferred at the predetermined pitch.

Besides, until the final toner image 70, that is, the toner image 70 in which toner images of four colors of yellow (Y), magenta (M), cyan (C) and black (BK) have been transferred so as to overlap with each other in the case where a full color image is formed, or the toner image 70 of one color to three colors in the case where an image of one color to three colors among yellow (Y), magenta (M), cyan (C) and black (BK) is formed, is transferred onto the image area 50 of the intermediate transfer belt 21, the backup roll 25 is in the state where the reverse transfer bias voltage of, for example, +600 V, remains applied.

When the final toner image 70 transferred onto the image area 50 of the intermediate transfer belt 21 in the manner as described above passes through the secondary transfer position, as shown in FIG. 9, the CPU 60 causes the high voltage power supply 47 for the transfer bias voltage to apply the transfer bias voltage of, for example, −2.2 KV to the backup roll 25. Thus, when the final toner image 70 transferred onto the image area 50 of the intermediate transfer belt 21 passes through the secondary transfer position, by the transfer bias voltage applied to the backup roll 25, the final toner image is transferred from the intermediate transfer belt 21 onto the recording sheet 26 conveyed to the secondary transfer position in synchronization with the toner image.

At that time, the transfer bias voltage applied to the backup roll 25 of the secondary transfer part is not limited to −2.2 KV, but is set to an optimum value to transfer the final toner image 70, which has been transferred onto the intermediate transfer belt 21, onto the recording sheet 26 when it passes through the secondary transfer position. Thus, in the color electrophotographic copying machine of the embodiment, as shown in FIG. 1, the humidity in the copying machine main body 1 is detected by the humidity sensor 59, and on the basis of the detection result of the humidity sensor 59, the CPU 60 controls the transfer bias voltage applied to the backup roll 25 within the range of −1.5 KV to −3.0 KV so that the optimum transfer property of the toner image 70 can be obtained.

On the other hand, when the patches 55Y, 55M, 55C and 55BK for the process control of the respective colors transferred onto the area of the intermediate transfer belt 21 corresponding to the paper feed interval of the recording sheet 26, and the sideways V-shaped patches 56Y, 56M, 56C and 56BK for the registration control of the respective colors pass through the secondary transfer position as shown in FIG. 9, the CPU 60 causes the state where the reverse transfer bias voltage of, for example, +600 V remains applied to the backup roll 25 all over the non-image area 51 according to the size of the selected recording sheet 26 through the high voltage power supply 47 for the transfer bias voltage. Thus, when the patches 55Y, 55M, 55C and 55BK for the process control of the respective colors transferred onto the non-image area 51 of the intermediate transfer belt 21 corresponding to the paper feed interval of the recording sheet 26, and the sideways V-shaped patches 56Y, 56M, 56C and 56BK for the registration control of the respective colors pass through the secondary transfer position, by the reverse transfer bias voltage applied to the backup roll 25, they are placed in the state where they remain transferred on the intermediate transfer belt 21, and they are not transferred onto the secondary transfer roll 27 which is in press contact with the intermediate transfer belt 21.

Thereafter, when the belt driving motor 63 for rotation driving the intermediate transfer belt 21 is stopped, application of the bias voltage to the backup roll 25 is turned OFF.

Incidentally, in the embodiment 1, as shown in FIG. 7, the contact angle of water on the surface of the secondary transfer roll 27 is controlled so that it becomes in the range of 85° to 100°. At this time, the contact angle of water on the surface of the intermediate transfer belt 21 is in the range of 70° to 80°, and the above relation is satisfied.

By doing so, as shown in FIG. 8, the mechanical adhesion force of toner to the secondary transfer roll 27 is made lower than the mechanical adhesion force of toner to the intermediate transfer belt 21, so that the toner becomes hard to shift from the intermediate transfer belt 21 to the secondary transfer roll 27.

Besides, the cleaning bias voltage applied to the backup roll 25 is set such that at the time of cleaning the secondary transfer roll 27, the electrostatic adhesion force of toner to the surface of the intermediate transfer belt 21 becomes larger than the electrostatic adhesion force of toner to the surface of the secondary transfer roll 27.

Like this, at the time of cleaning the secondary transfer roll 27, both the electrostatic adhesion force and the mechanical adhesion force of the toner to the surface of the intermediate transfer belt 21 are set larger than the electrostatic adhesion force and the mechanical adhesion force of the toner to the surface of the secondary transfer roll 27. Thus, while the toner is prevented from shifting to the surface of the secondary transfer roll 27, the toner adhered to the surface of the secondary transfer roll 27 can be certainly sifted from the surface of the secondary transfer roll 27 to the surface of the intermediate transfer belt 21 by both the electrostatic adhesion force and the mechanical adhesion force, and it becomes possible to finely clean the secondary transfer roll 27 at all times. Thus, without using a specific cleaning part, such as a blade, for cleaning the surface of the secondary transfer roll 27, the excellent cleaning property of the transfer roll can be assured. Since the surface of the secondary transfer roll 27 is not abraded by the cleaning part such as the blade, the reliability can be improved and the life of the secondary transfer roll 27 can be extended to about twice the original life. Besides, since it is not necessary to use the specific cleaning part, such as the blade, for cleaning the surface of the secondary transfer roll 27, the cleaning part for the secondary transfer roll 27 becomes unnecessary, and the number of parts can be decreased.

Embodiment 2

Figure 10:
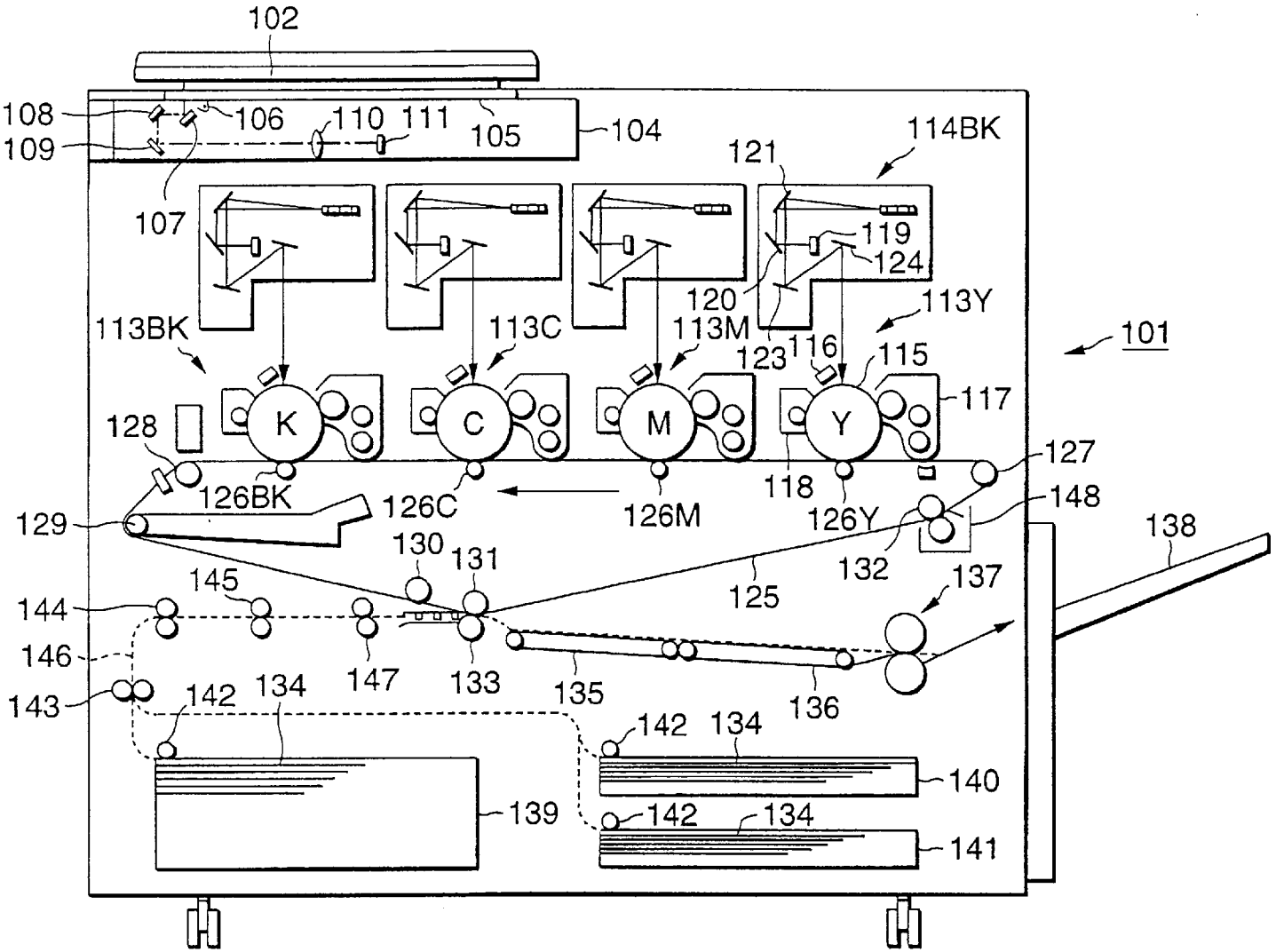
FIG. 10 is a structural view showing a tandem type color electrophotographic copying machine as an image forming apparatus according to embodiment 2 of the present invention.

FIG. 10 shows embodiment 2 of the present invention. The embodiment 2 is different from the embodiment 1 in the structure of an image forming part. The image forming part includes plural image forming units each of which includes an image carrier on which an electrostatic latent image is formed and a developing part for developing the electrostatic latent image formed on the image carrier with a toner of a predetermined color. Plural toner images of different colors are sequentially formed by the plural image forming units.

FIG. 10 shows a tandem type color electrophotographic copying machine as an image forming apparatus of the embodiment 2 of the present invention.

In FIG. 10, reference numeral 101 designates a main body of the tandem type digital color copying machine. A platen cover 103 for pressing an original document 102 onto a platen glass 105, and an original document reading device 104 for reading an image of the original document 102 put on the platen glass 105 are disposed on the upper portion of the digital color copying machine main body 101 at one end side. In this original document reading device 104, the original document 102 put on the platen glass 105 is illuminated by a light source 106, a reflected light image from the original document 102 is scanned and exposed onto an image reading element 111 made of CCDs and the like through a reducing optical system constituted by a full rate mirror 107, half rate mirrors 108, 109, and an imaging lens 110, and a colorant reflected light image of the original document 102 is read by this image reading element 111 at a predetermined dot density (for example, 16 dots/mm).

The colorant reflected light image of the original document 102 read by the original document reading device 104 is sent as, for example, original document reflectivity data of three colors of red (R), green (G) and blue (B) (each has 8 bits), to an IPS 112 (Image Processing System). In this IPS 112, predetermined image processing, such as shading correction, position shift correction, brightness/color space conversion, gamma correction, frame erasure, or color/movement edition, is carried out to the reflectivity data of the original document 102.

The image data subjected to the predetermined image processing by the IPS 112 as described above are converted into original document colorant gradation data of four colors of yellow (Y), magenta (M), cyan (C), and black (BK) (each has 8 bits), and are sent to ROSs 114Y, 114M, 114C, and 114BK (Raster Output Scanner) of image forming units 113Y, 113M, 113C and 113BK of the respective colors of yellow (Y), magenta (M), cyan (C) and black (BK). In these ROSs 114Y, 114M, 114C and 114BK, image exposure by a laser beam is carried out in accordance with the original document colorant gradation data of a predetermined color.

In the inside of the tandem type digital color copying machine main body 101, the four image forming units 113Y, 113M, 113C and 113BK of yellow (Y), magenta (M), cyan (C) and black (BK) are disposed in the horizontal direction at a constant interval and in parallel.

All of these four image forming units 113Y, 113M, 113C and 113BK are structured in the same way, and each unit is roughly constructed by a photoreceptor drum 115 rotating in the direction of an arrow at a predetermined rotation speed, a primary charging screen corotron 116 which uniformly charges the surface of the photoreceptor drum 115, a ROS 114 for forming an electrostatic latent image by exposing an image corresponding to each color onto the surface of the photoreceptor drum 115, a developing unit 117 for developing the electrostatic latent image formed on the photoreceptor drum 115, and a cleaning device 118.

As shown in FIG. 10, in the ROS 114, a semiconductor laser 119 is modulated in accordance with the original document colorant gradation data, and this semiconductor laser 119 emits a laser beam LB in accordance with the gradation data. The laser beam LB emitted from the semiconductor laser 119 is deflected and scanned by a rotary polygon mirror 122 through reflecting mirrors 120 and 121, and is again scanned and exposed onto the photoreceptor drum 115 as an image carrier through the reflecting mirrors 120 and 121 and plural reflecting mirrors 123 and 124.

Image data of the respective colors are sequentially outputted from the EPS 12 to the ROSs 114Y, 114M, 114C and 114BK of the image forming units 113Y, 113M, 113C and 113BK of the respective colors of yellow (Y), magenta (M), cyan (C) and black (BK). The laser beam LB emitted from the respective ROSs 114Y, 114M, 114C and 114BK in accordance with the image data is scanned and exposed onto the surface of the respective photoreceptor drums 115Y, 115M, 115C and 115BK and electrostatic latent images are formed. The electrostatic latent images formed on the respective photoreceptor drums 115Y, 115M, 115C and 115BK are developed as toner images of the respective colors of yellow (Y), magenta (M), cyan (C) and black (BK) by the developing units 117Y, 117M, 117C and 117BK.

The toner images of the respective colors of yellow (Y), magenta (M), cyan (C) and black (BK) sequentially formed on the photoreceptor drums 115Y, 115M, 115C and 115BK of the respective image forming units 113Y, 113M, 113C and 113BK are transferred so as to overlap with each other by primary transfer rolls 126Y, 126M, 126C and 126BK onto an intermediate transfer belt 125 disposed below the respective image forming units 113Y, 113M, 113C and 113BK. This transfer belt 125 is put with a constant tension around a drive roll 127, a stripping roll 128, a steering roll 129, an idle roll 130, a backup roll 131, and an idle roll 132, and is driven to circulate at a predetermined speed in the direction of an arrow by the drive roll 127 which is driven to rotate by a not-shown dedicated driving motor having an excellent constant speed property. As the transfer belt 125, for example, a synthetic resin film of PET or the like having flexibility is formed into a belt shape, and both ends of the beltshaped synthetic resin film are connected by a method such as welding to form an endless belt shape one, which is used.

The toner images of the respective colors of yellow (Y), magenta (M), cyan (C) and black (BK) transferred onto the transfer belt 125 so as to overlap with each other are secondarily transferred onto a recording sheet 134 through a pressing force and an electrostatic force by a secondary transfer roll 133 which comes in press contact with the backup roll 131. The recording sheet 134 onto which the toner images of the respective colors have been transferred is conveyed to a fixing unit 137 by two conveying belts 135 and 136. Then the recording sheet 134 on which the toner images of the respective colors have been transferred is subjected to a fixing process through heat and pressure by the fixing unit 137, and is discharged onto a discharge tray 138 provided at the outside of the copying machine main body 101.

As shown in FIG. 10, the recording sheet 134 of a predetermined size is once conveyed from either one of plural sheet feed cassettes 139, 140 and 141 to a registration roll 147 through a sheet conveying passage 146 made of a sheet feed roll 142 and sheet conveying roll pairs 143, 144 and 145. The transfer sheet 134 supplied from either one of the sheet feed cassettes 139, 140 and 141 is sent onto the intermediate transfer belt 125 by the registration roll 147 which is driven to rotate at predetermined timing.

In the four image forming units 113Y, 113M, 113C and 113BK of yellow, magenta, cyan and black, as described above, the toner images of yellow, magenta, cyan and black are sequentially formed at the predetermined timing.

Incidentally, with respect the photoreceptor drums 115Y, 115M, 115C and 115BK, after the transfer step of the toner images is ended, the remaining toner, paper powder, and the like are removed by the cleaning devices 118Y, 118M, 118C and 118BK, and they are prepared for a next image forming process. Besides, with respect to the intermediate transfer belt 125, the remaining toner is removed by a cleaner 148 for a belt.

Similarly to the embodiment 1, the tandem type color electrophotographic copying machine is also constructed such that at the time of cleaning the secondary transfer roll 133, both the electrostatic adhesion force and the mechanical adhesion force of toner to the surface of the intermediate transfer belt 125 becomes larger than the electrostatic adhesion force and the mechanical adhesion force of toner to the surface of the secondary transfer roll 133.

Since the other structures and functions are the same as the embodiment 1, their description will be omitted.

A color electrophotographic copying machine according to embodiment 3 is constructed such that a cleaning bias voltage having a polarity opposite to a transfer bias voltage is applied to at least one of a backup roll and a transfer roll, and an output value of the cleaning bias voltage is controlled so that a potential difference between a belt-like image carrier and the transfer roll becomes optimum for cleaning.

More specifically, the cleaning bias voltage having the polarity opposite to the transfer bias voltage is applied to at least one of the backup roll and the transfer roll, and the output value of the cleaning bias voltage is controlled according to a system resistance between the backup roll and the transfer roll.

Figure 11:
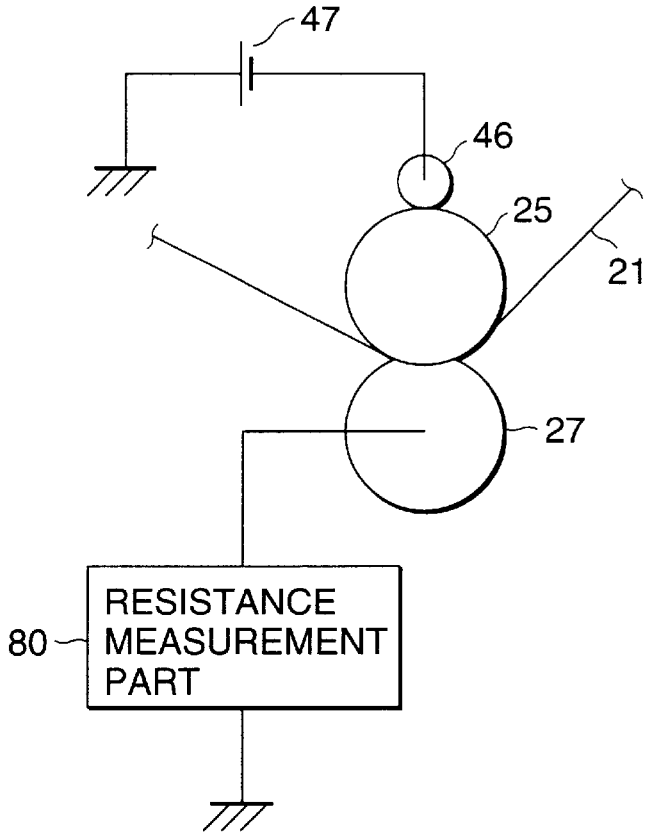
FIG. 11 is a structural view showing a measurement part of a system resistance value of a secondary transfer portion.

That is, the color electrophotographic copying machine of the embodiment 3 is constructed such that as shown in FIG. 11, a constant bias current (for example, 60 $\mu$A) is made to flow to a backup roll 25 through a bias roll 46, and a voltage applied to a secondary transfer roll 27 is measured by a resistance measurement part 80, so that the system resistance of a secondary transfer portion is measured. Here, the system resistance of the secondary transfer portion means a resistance between the backup roll 25 and the secondary transfer roll 27 which are in press contact with each other through an intermediate transfer belt 21.

Figure 12:
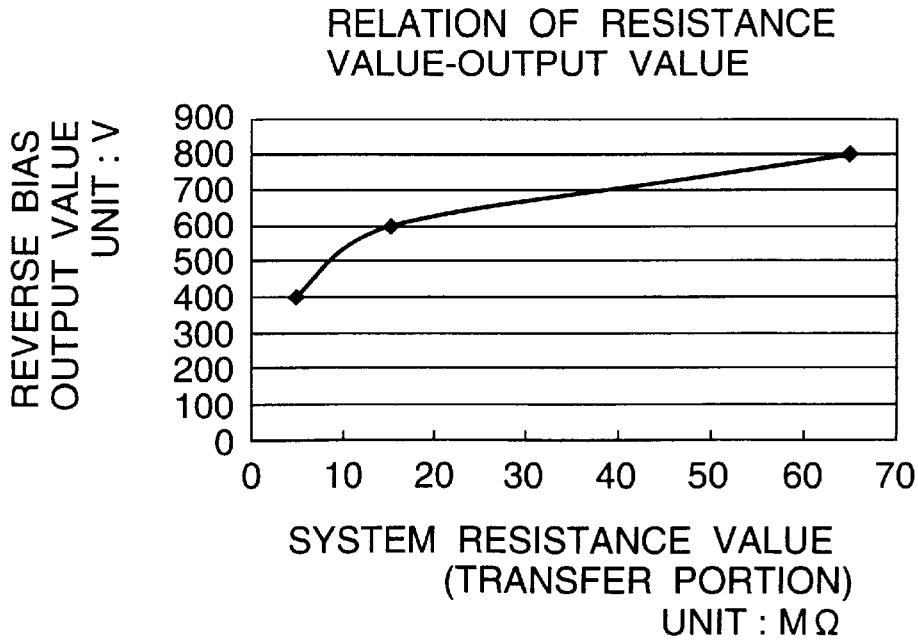
FIG. 12 is a graph showing the relation between the system resistance value of the secondary transfer portion and reverse bias output value.

As shown in FIG. 12, a CPU 60 is designed to operate so that an optimum voltage value of cleaning bias is determined according to a resistance value of the system resistance from a table of resistance values of the system resistance and the cleaning bias previously stored in a RAM 65 or the like, and the optimum voltage value of the cleaning bias is applied to the backup roll 25 through the bias roll 46 by a high voltage power supply 47 for transfer bias.

In the above structure, according to the color electrophotographic copying machine of the embodiment 3, even in the case where an environment variation or a change with time occurs, it is possible to finely clean the transfer part at all times through the following manner.

That is, as shown in FIG. 2, in the color electrophotographic copying machine of the embodiment 3, when the original document 2 is set at a predetermined position, the user interface 61 is operated to specify the number of sheets to be copied, copying magnification, size of the recording sheet 26, or the like, and the copy button is pressed, by the control of the CPU 60, the photoreceptor drum 17 is driven to rotate, and as shown in FIG. 9, the belt driving motor 63 for rotation driving the intermediate transfer belt 21 is turned ON, and the intermediate transfer belt 21 is driven to rotate. Besides, by the CPU 60 as the transfer bias voltage application control part, at the same time as the rotation of the intermediate transfer belt 21, the reverse bias voltage (cleaning bias voltage) of, for example, +600 V is applied through the high voltage power supply 47 for the transfer bias voltage to the backup roll 25 of the secondary transfer part. Incidentally, the embodiment 3 is constructed such that while the belt driving motor 63 rotates, the secondary transfer roll 27 is put in the state where it remains being in press contact with the intermediate transfer belt 21.

Onto the image area 50 of the intermediate transfer belt 21, as shown in FIG. 4 and FIG. 9, at the setup operation after the copy button for starting the copying operation is pressed and before the copying operation is actually started, the plural patches 53Y, 53M, 53C and 53BK for the process control of the respective colors of yellow (Y), magenta (M), cyan (C), and black (BK) formed on the photoreceptor drum 17 are transferred at different densities, and the sideways V-shaped patches 54Y, 54M, 54C and 54BK for the registration control of the respective colors of yellow (Y), magenta (M), cyan (C), and black (BK) are transferred at a predetermined pitch. The patches 53Y, 53M, 53C and 53BK for the process control of the respective colors transferred onto the image area 50 of the intermediate transfer belt 21, and the sideways V-shaped patches 54Y, 54M, 54C and 54BK for the registration control of the respective colors are detected by the optical sensor 57 as shown in FIG. 1. The data of density and position of the patches for the process control and the patches for the registration control are sent to the CPU 60 as shown in FIG. 6. The CPU 60 judges whether the data of density and position of the patches for the process control and the patches for the registration control are within a predetermined range, and controls various parameters for image formation so that the data of density and position of the patches are placed within the predetermined range.

Besides, also when the patches 53Y, 53M, 53C and 53BK for the process control of the respective colors transferred onto the image area 50 of the intermediate transfer belt 21, and the patches 54Y, 54M, 54C and 54BK for the registration control of the respective colors pass through the secondary transfer position, the CPU 60 maintains the state, as shown in FIG. 9, where the reverse transfer bias voltage of, for example, +600 V, remains applied to the backup roll 25 through the high voltage power supply 47 for the transfer bias voltage. Thus, when the patches 53Y, 53M, 53C and 53BK for the process control of the respective colors transferred onto the image area 50 of the intermediate transfer belt 21, and the patches 54Y, 54M, 54C and 54BK for the registration control of the respective colors pass through the secondary transfer position, they are placed in the state where they remain transferred on the intermediate transfer belt 21 by the reverse transfer bias voltage applied to the backup roll 25, and are not transferred onto the secondary transfer roll 27 which is in press contact with the intermediate transfer belt 21. Incidentally, the patches 53Y, 53M, 53C and 53BK for the process control of the respective colors transferred onto the image area 50 of the intermediate transfer belt 21, and the patches 54Y, 54M, 54C and 54BK for the registration control of the respective colors are thereafter removed from the intermediate transfer belt 21 by the intermediate transfer belt cleaner 43.

Next, onto the image area 50 of the intermediate transfer belt 21 and the area corresponding to the paper feed interval of the recording sheet 26, as shown in FIG. 5 and FIG. 9, a toner image 70 corresponding to the image of the original document 2 formed on the photoreceptor drum 17 and the patches 55Y, 55M, 55C and 55BK for the process control of the respective colors of yellow (Y), magenta (M), cyan (C) and black (BK) are transferred at two kinds of densities, and the sideways V-shaped patches 56Y, 56M, 56C and 56BK for the registration control of the respective colors of yellow (Y), magenta (M), cyan (C) and black (BK) are transferred at the predetermined pitch.

At that time, in the case where a full color image is formed, the toner images of the respective colors of yellow (Y), magenta (M), cyan (C) and black (BK) are sequentially transferred onto the image area 50 of the intermediate transfer belt 21 every rotation of the photoreceptor drum 17. Besides, onto the area corresponding to the paper feed interval of the recording sheet 26, the patches 55Y, 55M, 55C and 55BK for the process control of the respective colors of yellow (Y), magenta (M), cyan (C) and black (BK) are transferred at two kinds of densities every rotation of the photoreceptor drum 17 as shown in FIG. 5, and the sideways V-shaped patches 56Y, 56M, 56C and 56BK for the registration control of the respective colors of yellow (Y), magenta (M), cyan (C) and black (BK) are transferred at the predetermined pitch.

Besides, until the final toner image 70, that is, the toner image 70 in which toner images of four colors of yellow (Y), magenta (M), cyan (C) and black (BK) have been transferred so as to overlap with each other in the case where a full color image is formed, or the toner image 70 of one color to three colors in the case where an image of one color to three colors among yellow (Y), magenta (M), cyan (C) and black (BK) is formed, is transferred onto the image area 50 of the intermediate transfer belt 21, the backup roll 25 is in the state where the reverse transfer bias voltage of, for example, +600 V, remains applied.

When the final toner image 70 transferred onto the image area 50 of the intermediate transfer belt 21 in the manner as described above passes through the secondary transfer position, as shown in FIG. 9, the CPU 60 causes the high voltage power supply 47 for the transfer bias voltage to apply the transfer bias voltage of, for example, −2.2 KV to the backup roll 25. Thus, when the final toner image 70 transferred onto the image area 50 of the intermediate transfer belt 21 passes through the secondary transfer position, by the transfer bias voltage applied to the backup roll 25, the final toner image is transferred from the intermediate transfer belt 21 onto the recording sheet 26 conveyed to the secondary transfer position in synchronization with the toner image.

At that time, the transfer bias voltage applied to the backup roll 25 of the secondary transfer part is not limited to −2.2 KV, but is set to an optimum value to transfer the final toner image 70, which has been transferred onto the intermediate transfer belt 21, onto the recording sheet 26 when it passes through the secondary transfer position. Thus, in the color electrophotographic copying machine of the embodiment, as shown in FIG. 1, the humidity in the copying machine main body 1 is detected by the humidity sensor 59, and on the basis of the detection result of the humidity sensor 59, the CPU 60 controls the transfer bias voltage applied to the backup roll 25 within the range of −1.5 KV to −3.0 KV so that the optimum transfer property of the toner image 70 can be obtained.

On the other hand, when the patches 55Y, 55M, 55C and 55BK for the process control of the respective colors transferred onto the area of the intermediate transfer belt 21 corresponding to the paper feed interval of the recording sheet 26, and the sideways V-shaped patches 56Y, 56M, 56C and 56BK for the registration control of the respective colors pass through the secondary transfer position, as shown in FIG. 9, the CPU 60 causes the state where the reverse transfer bias voltage of, for example, +600 V remains applied to the backup roll 25 all over the non-image area 51 according to the size of the selected recording sheet 26 through the high voltage power supply 47 for the transfer bias voltage. Thus, when the patches 55Y, 55M, 55C and 55BK for the process control of the respective colors transferred onto the non-image area 51 of the in intermediate transfer belt 21 corresponding to the paper feed interval of the recording sheet 26, and the sideways V-shaped patches 56Y, 56M, 56C and 56BK for the registration control of the respective colors pass through the secondary transfer position, by the reverse transfer bias voltage applied to the backup roll 25, they are placed in the state where they remain transferred on the intermediate transfer belt 21, and they are not transferred onto the secondary transfer roll 27 which is in press contact with the intermediate transfer belt 21.

Thereafter, when the belt driving motor 63 for rotation driving the intermediate transfer belt 21 is stopped, application of the bias voltage to the backup roll 25 is turned OFF.

In the embodiment 3, as shown in FIG. 11, a constant bias current (for example, 60 $\mu$A) is made to flow to the backup roll 25 through the bias roll 46, and a voltage applied to the secondary transfer roll 27 is measured by the resistance measurement part 80, so that the system resistance of the secondary transfer portion is measured. Then, as shown in FIG. 12, the CPU 60 operates so that the optimum voltage value of cleaning bias is determined according to the resistance value of the system resistance from the table of resistance values of the system resistance and the cleaning bias previously stored in the RAM 65 or the like, and the optimum voltage value of the cleaning bias is applied to the backup roll 25 through the bias roll 46 by the high voltage power supply 47 for transfer bias.

Like this, since the output value of the cleaning bias voltage is controlled by actually measuring the system resistance between the backup roll 25 and the transfer roll 27 and control is made according to the measurement value of the system resistance, even in the case where an environmental variation or a change with time occurs, the output value of the cleaning bias voltage can be maintained such that the potential difference between the intermediate transfer belt 21 and the transfer roll 27 becomes optimum for cleaning, and it becomes possible to finely clean the transfer part at all times.

Since the other structures and functions are the same as the embodiment 1, their description is omitted.

Embodiment 4

Figure 13:
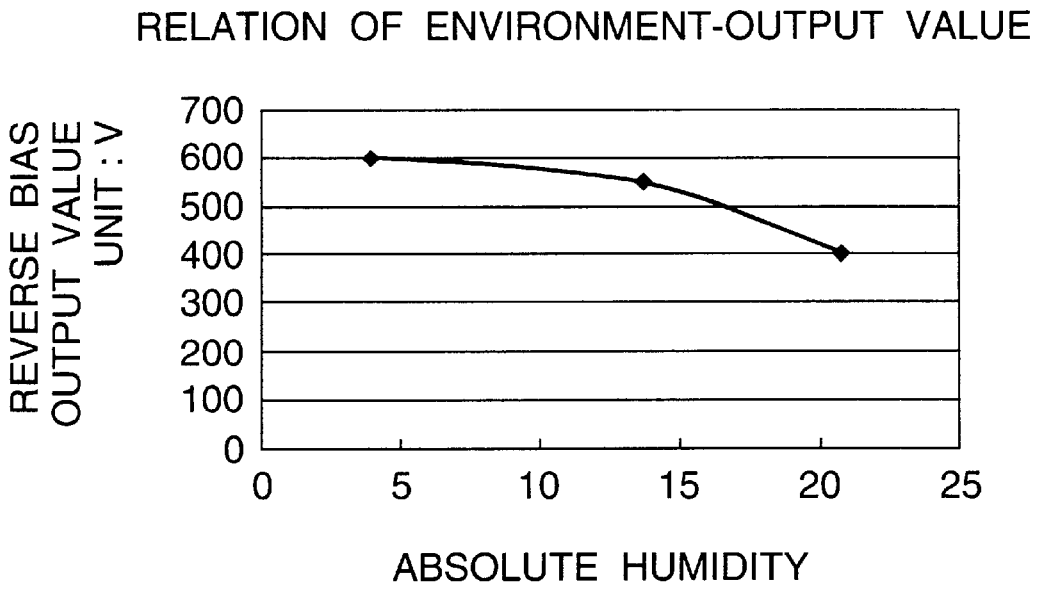
FIG. 13 is a graph showing the relation between absolute humidity and reverse bias output value.

FIG. 13 shows embodiment 4 of the present invention, and the same portions as the embodiment 1 are designated by the same symbols. This embodiment 4 is constructed such that a cleaning bias voltage having a polarity opposite to a transfer bias voltage is applied to at least one of a backup roll and a transfer roll, and an output value of the cleaning bias voltage is controlled according to environmental variation.

That is, in the embodiment 4, as shown in FIG. 1, the humidity in the inside of the copying machine main body 1 is detected by the humidity sensor 59 provided in the inside of the copying machine main body 1. Then, the CPU 60 obtains the absolute humidity from the following equation on the basis of the relative humidity detected by the humidity sensor 59.

$$\text{absolute humidity}\times 10^{-3}=15.375-0.077\times(\text{humidity})+0.027\times(\text{temperature})^2\times(\text{relative humidity})/100$$

Incidentally, as shown in FIG. 1, the temperature of the copying machine main body 1 is detected by the temperature sensor 66 provided together with the humidity sensor 59.

As shown in FIG. 13, the CPU 60 determines an optimum voltage value of cleaning bias according to the absolute humidity from a table of absolute humidity and cleaning bias previously stored in the RAM 65 or the like, and the optimum voltage value of the cleaning bias is applied to the backup roll 25 through the bias roll 46 by the high voltage power supply 47 for transfer bias.

Like this, this embodiment is constructed such that the cleaning bias voltage having the polarity opposite to the transfer bias voltage is applied to the backup roll 25, and the output value of the cleaning bias voltage is controlled according to the environmental variation of humidity or the like. Thus, even in the case where the environment of temperature or humidity is changed, the output value of cleaning bias voltage can be maintained so that the potential difference between the intermediate transfer belt 21 and the secondary transfer roll 27 becomes optimum for cleaning, and it becomes possible to finely clean the transfer part at all times.

Since the other structures and functions are the same as the embodiment 1, their description is omitted.

Embodiment 5

Figure 14:
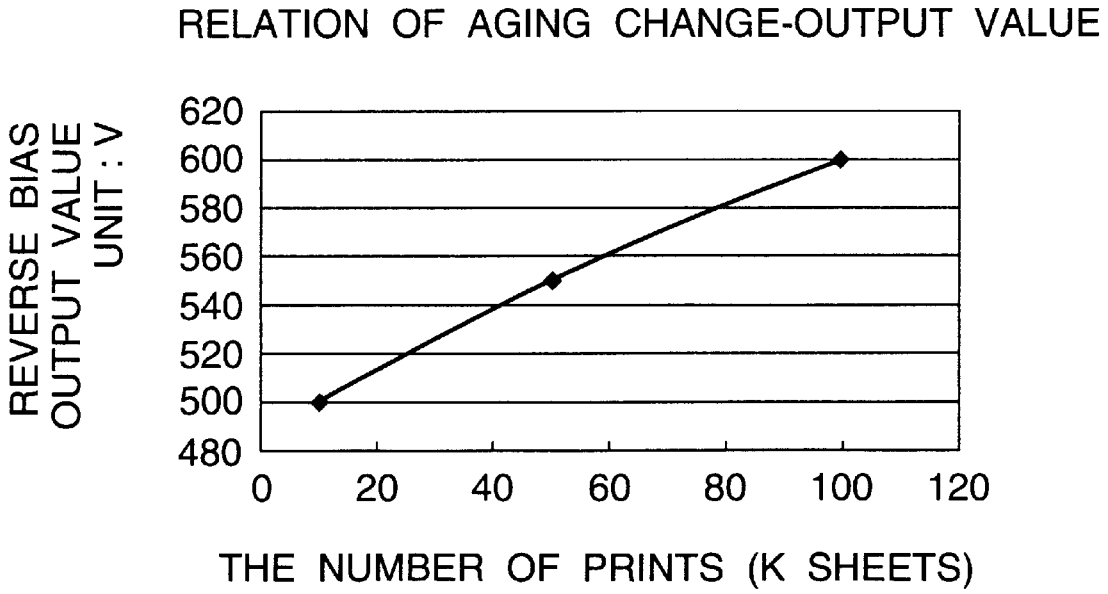
FIG. 14 is a graph showing the relation between the number of prints and reverse bias output value.

FIG. 14 shows embodiment 5 of the present invention, and the same portions as the embodiment 1 are designated by the same symbols. This embodiment 5 is constructed such that a cleaning bias voltage having a polarity opposite to a transfer bias voltage is applied to at least one of a backup roll and a transfer roll, and an output value of the cleaning bias voltage is controlled according to a use history of the image forming apparatus.

That is, in this embodiment 5, the number of prints indicating the use history of the apparatus is counted with the CPU 60, and as shown in FIG. 14, the CPU 60 determines an optimum voltage value of cleaning bias according to the number of prints from a table of the number of prints and cleaning bias previously stored in RAM 65 or the like, and the optimum voltage value of cleaning bias is applied to the backup roll 25 through bias roll 46.

Like this, this embodiment is constructed such that the cleaning bias voltage having the polarity opposite to the transfer bias voltage is applied to the backup roll 25 and the output value of the cleaning bias voltage is controlled according to the use history of the copying machine. Thus, even in the case where the system resistance of the secondary transfer portion is changed with the passage of time, the output value of the cleaning bias voltage can be maintained so that the potential difference between the intermediate transfer belt 21 and the transfer roll 27 becomes optimum for cleaning, and it becomes possible to finely clean the secondary transfer roll 27 at all times.

Since the other structures and functions are the same as the embodiment 1, their description is omitted.

Embodiment 6

Figure 15:
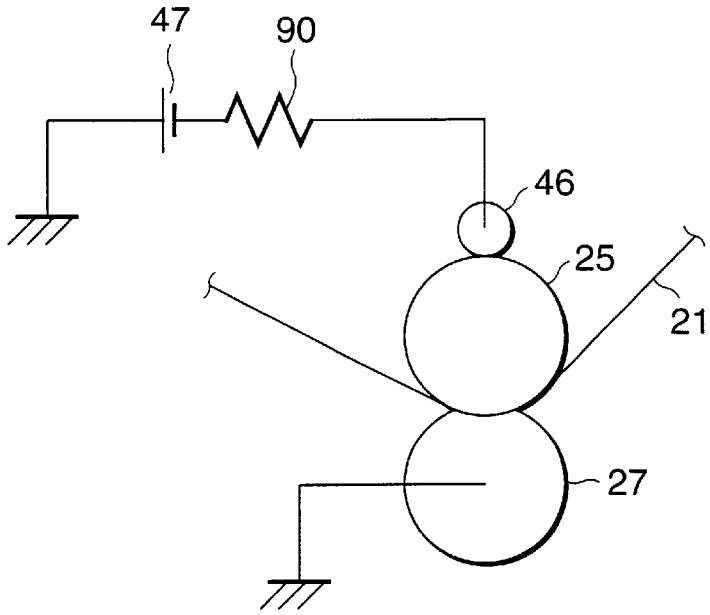
FIG. 15 is a structural view showing the main part of a color electrophotographic copying machine as an image forming apparatus according to embodiment 6 of the present invention.

FIG. 15 shows embodiment 6 of the present invention, and the same portions as the embodiment 1 are designated by the same symbols. This embodiment 6 is constructed such that a cleaning bias voltage having a polarity opposite to a transfer bias voltage is applied to at least one of a backup roll and a transfer roll, and a resistor of a predetermined value corresponding to a system resistance between the backup roll and the transfer roll is provided between a cleaning bias power supply and a transfer portion so that a potential difference between a belt-like image carrier and the transfer roll becomes a value suitable for cleaning. The resistance value of the resistor is set so that the optimum cleaning bias can always be applied against the change of the system resistance of the transfer portion.

Figure 16:
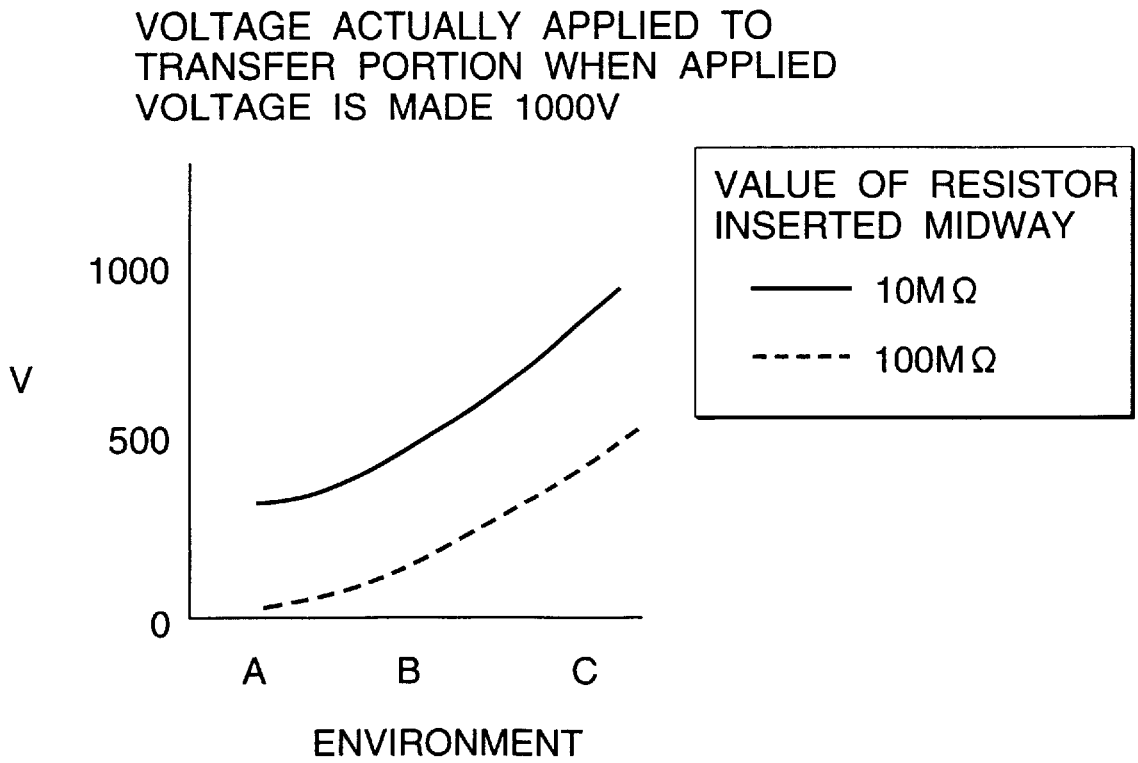
FIG. 16 is a graph showing the relation between the change of environmental condition and voltage applied to a transfer portion.

That is, it has been clarified by the study of the present inventor et al. that the system resistance of the secondary transfer portion is changed within a range by the environment of temperature, humidity or the like or with the passage of time. Then, the embodiment 6 is constructed such that a resistor 90 is provided between the secondary transfer portion and the transfer bias power supply 47 so that an optimum cleaning bias can be obtained against the change of the system resistance of the secondary transfer portion. With respect to the resistance value of the resistor 90, for example, in the case where the resistance of the secondary transfer portion is changed within the range of 30 MΩ to 300 MΩ, when the resistor of 10 MΩ is provided, even if a specific control such as a constant voltage control is not carried out, as shown in FIG. 16, it becomes possible to apply a low value corresponding to a case where the resistance value of system resistance is low, and a high value corresponding to a case where the resistance value of the system resistance is high. Incidentally, in FIG. 16, environment A indicates a high temperature high humidity environment, environment B indicates an environment at general room temperature, and environment C indicates a low temperature low humidity environment.

Since the control such as the constant voltage control is not carried out, it does not take a time required for the control and a responsibility also becomes excellent.

In the case where the resistance value of the resistor 90 provided between the secondary transfer portion and the transfer bias power supply 47 is changed, the relation between the actually applied voltage and environment (resistance value) is shown in FIG. 16.

Like this, this embodiment is constructed such that the cleaning bias voltage having the polarity opposite to the transfer bias voltage is applied to the backup roll 25, and the resistor of the predetermined value corresponding to the system resistance between the backup roll 25 and the secondary transfer roll 27 is provided between the cleaning bias power supply 47 and the transfer portion so that the potential difference between the intermediate transfer belt 21 and the secondary transfer roll 27 becomes the value suitable for cleaning. Thus, by the simple structure that the resistor 90 of the predetermined value corresponding to the system resistance between the backup roll 25 and the secondary transfer roll 27 is provided between the cleaning bias power supply 47 and the transfer portion, the potential difference between the intermediate transfer belt 21 and the secondary transfer roll 27 can be made the value suitable for cleaning, and even in the case where the environmental variation or change with time occurs, it becomes possible to finely clean the secondary transfer roll 27 at all times.

Since the other structures and functions are the same as the embodiment 1, their description is omitted.

Embodiment 7

FIG. 10 shows embodiment 7 of the present invention. The embodiment 7 is different from the embodiment 1 in the structure of an image forming part. The image forming part includes plural image forming units each of which includes an image carrier on which an electrostatic latent image is formed and a developing part for developing the electrostatic latent image formed on the image carrier with a toner of a predetermined color. Plural toner images of different colors are sequentially formed by the plural image forming units.

FIG. 10 shows a tandem type color electrophotographic copying machine as an image forming apparatus of the embodiment 7 of the present invention.

In FIG. 10, reference numeral 101 designates a main body of the tandem type digital color copying machine. A platen cover 103 for pressing an original document 102 onto a platen glass 105, and an original document reading device 104 for reading an image of the original document 102 put on the platen glass 105 are disposed on the upper portion of the digital color copying machine main body 101 at one end side. In this original document reading device 104, the original document 102 put on the platen glass 105 is illuminated by a light source 106, a reflected light image from the original document 102 is scanned and exposed onto an image reading element 111 made of CCDs and the like through a reducing optical system constituted by a full rate mirror 107, half rate mirrors 108, 109, and an imaging lens 110, and a colorant reflected light image of the original document 102 is read by this image reading element 111 at a predetermined dot density (for example, 16 dots/mm).

The colorant reflected light image of the original document 102 read by the original document reading device 104 is sent as, for example, original document reflectivity data of three colors of red (R), green (G) and blue (B) (each has 8 bits), to an IPS 112 (Image Processing System). In this IPS 112, predetermined image processing, such as shading correction, position shift correction, brightness/color space conversion, gamma correction, frame erasure, or color/movement edition, is carried out to the reflectivity data of the original document 102.

The image data subjected to the predetermined image processing by the IPS 112 as described above are converted into original document colorant gradation data of four colors of yellow (Y), magenta (M), cyan (C), and black (BK) (each has 8 bits), and are sent to ROSs 114Y, 114M, 114C, and 114BK (Raster Output Scanner) of image forming units 113Y, 113M, 113C and 113BK of the respective colors of yellow (Y), magenta (M), cyan (C) and black (BK). In these ROSs 114Y, 114M, 114C and 114BK, image exposure by a laser beam is carried out in accordance with the original document colorant gradation data of a predetermined color.

In the inside of the tandem type digital color copying machine main body 101, the four image forming units 113Y, 113M, 113C and 113BK of yellow (Y), magenta (M), cyan (C) and black (BK) are disposed in the horizontal direction at a constant interval and in parallel.

All of these four image forming units 113Y, 113M, 113C and 113BK are structured in the same way, and each unit is roughly constructed by a photoreceptor drum 115 rotating in the direction of an arrow at a predetermined rotation speed, a primary charging screen corotron 116 which uniformly charges the surface of the photoreceptor drum 115, a ROS 114 for forming an electrostatic latent image by exposing an image corresponding to each color onto the surface of the photoreceptor drum 115, a developing unit 117 for developing the electrostatic latent image formed on the photoreceptor drum 115, and a cleaning device 118.

As shown in FIG. 10, in the ROS 114, a semiconductor laser 119 is modulated in accordance with the original document colorant gradation data, and this semiconductor laser 119 emits a laser beam LB in accordance with the gradation data. The laser beam LB emitted from the semiconductor laser 119 is deflected and scanned by a rotary polygon mirror 122 through reflecting mirrors 120 and 121, and is again scanned and exposed onto the photoreceptor drum 115 as an image carrier through the reflecting mirrors 120 and 121 and plural reflecting mirrors 123 and 124.

Image data of the respective colors are sequentially outputted from the IPS 12 to the ROSs 114Y, 114M, 114C and 114BK of the image forming units 113Y, 113M, 113C and 113BK of the respective colors of yellow (Y), magenta (M), cyan (C) and black (BK). The laser beam LB emitted from the respective ROSs 114Y, 114M, 114C and 114BK in accordance with the image data is scanned and exposed onto the surface of the respective photoreceptor drums 115Y, 115M, 115C and 115BK and electrostatic latent images are formed. The electrostatic latent images formed on the respective photoreceptor drums 115Y, 115M, 115C and 115BK are developed as toner images of the respective colors of yellow (Y), magenta (M), cyan (C) and black (BK) by the developing units 117Y, 117M, 117C and 117BK.

The toner images of the respective colors of yellow (Y), magenta (M), cyan (C) and black (BK) sequentially formed on the photoreceptor drums 115Y, 115M, 115C and 115BK of the respective image forming units 113Y, 113M, 113C and 1113BK are transferred so as to overlap with each other by primary transfer rolls 126Y, 126M, 126C and 126BK onto an intermediate transfer belt 125 disposed below the respective image forming units 113Y, 113M, 113C and 113BK. This transfer belt 125 is put with a constant tension around a drive roll 127, a stripping roll 128, a steering roll 129, an idle roll 130, a backup roll 131, and an idle roll 132, and is driven to circulate at a predetermined speed in the direction of an arrow by the drive roll 127 which is driven to rotate by a not-shown dedicated driving motor having an excellent constant speed property. As the transfer belt 125, for example, a synthetic resin film of PET or the like having flexibility is formed into a belt shape, and both ends of the beltshaped synthetic resin film are connected by a method such as welding to form an endless belt shape one, which is used.

The toner images of the respective colors of yellow (Y), magenta (M), cyan (C) and black (BK) transferred onto the transfer belt 125 so as to overlap with each other are secondarily transferred onto a recording sheet 134 through a pressing force and an electrostatic force by a secondary transfer roll 133 which comes in press contact with the backup roll 131. The recording sheet 134 onto which the toner images of the respective colors have been transferred is conveyed to a fixing unit 137 by two conveying belts 135 and 136. Then the recording sheet 134 on which the toner images of the respective colors have been transferred is subjected to a fixing process through heat and pressure by the fixing unit 137, and is discharged onto a discharge tray 138 provided at the outside of the copying machine main body 101.

As shown in FIG. 10, the recording sheet 134 of a predetermined size is once conveyed from either one of plural sheet feed cassettes 139, 140 and 141 to a registration roll 147 through a sheet conveying passage 146 made of a sheet feed roll 142 and sheet conveying roll pairs 143, 144 and 145. The transfer sheet 134 supplied from either one of the sheet feed cassettes 139, 140 and 141 is sent onto the intermediate transfer belt 125 by the registration roll 147 which is driven to rotate at predetermined timing.

In the four image forming units 113Y, 113M, 113C and 113BK of yellow, magenta, cyan and black, as described above, the toner images of yellow, magenta, cyan and black are sequentially formed at the predetermined timing.

Incidentally, with respect the photoreceptor drums 115Y, 115M, 115C and 115BK, after the transfer step of the toner images is ended, the remaining toner, paper powder, and the like are removed by the cleaning devices 118Y, 118M, 118C and 118BK, and they are prepared for a next image forming process. Besides, with respect to the intermediate transfer belt 125, the remaining toner is removed by a cleaner 148 for a belt.

Similarly to the embodiment 3, the tandem type color electrophotographic copying machine is also constructed such that there is provided a CPU as a transfer bias voltage application control part which makes such control that in the case where at least a part of the toner image transferred onto the non-image area 51 and the image area 50 on the intermediate transfer belt 125 is positioned on an area of the intermediate transfer belt 125 other than an area corresponding to the recording medium 134, with respect to the backup roll 131 and the secondary transfer roll 133 as the second transfer part, a reverse transfer bias voltage having a polarity opposite to a transfer bias voltage is applied to at least the area other than the recording medium 134. In this embodiment 7, similarly to the embodiments 3 to 6, for example, a cleaning bias voltage having a polarity opposite to the transfer bias voltage is applied to at least one of the backup roll and the transfer roll, and an output value of the cleaning bias voltage is controlled so that the potential difference between the belt-like image carrier and the transfer roll becomes optimum for cleaning.

Since the other structures and functions are the same as the embodiments 3 to 6, their description is omitted.

As described above, the present invention can provide the image forming apparatus capable of finely cleaning the transfer part at all times even in the case where the environmental variation or change with time occurs.

Moreover, as described above, the present invention can provide the image forming apparatus capable of finely cleaning the transfer roll at all times by regulating the relation between the mechanical adhesion force of toner to the surface of the transfer roll and the mechanical adhesion force of toner to the surface of the image carrier with which the transfer roll comes in press contact.

What is claimed is:

1. An image forming apparatus comprising:

a belt-like image carrier which holds a visible image formed of a charged colorant and is circularly moved;

a transfer roll which is disposed to be brought into press contact with a front surface of the image carrier through a recording medium and collectively transfers the visible image on the image carrier onto the recording medium;

a backup roll which is disposed opposite to the transfer roll to be brought into press contact with a rear surface of the belt-like image carrier and forms a transfer nip region of a predetermined width with the transfer roll; and a transfer bias application part which applies a transfer bias voltage to at least one of the backup roll and the transfer roll;

wherein a cleaning bias voltage having a polarity opposite to the transfer bias voltage is applied to at least one of the backup roll and the transfer roll, and an output value of the cleaning bias voltage is controlled so that a potential difference between the belt-like image carrier and the transfer roll becomes optimum for cleaning and the output value of the cleaning bias voltage is controlled according to a system resistance between the backup roll and the transfer roll.

2. An image forming apparatus comprising:

a belt-like image carrier which holds a visible image formed of a charged colorant and is circularly moved;

a transfer roll which is disposed to be brought into press contact with a front surface of the image carrier through a recording medium and collectively transfers the visible image on the image carrier onto the recording medium;

a backup roll which is disposed opposite to the transfer roll to be brought into press contact with a rear surface of the belt-like image carrier and forms a transfer nip region of a predetermined width with the transfer roll; and a transfer bias application part which applies a transfer bias voltage to at least one of the backup roll and the transfer roll;

wherein a cleaning bias voltage having a polarity opposite to the transfer bias voltage is applied to at least one of the backup roll and the transfer roll, and an output value of the cleaning bias voltage is controlled so that a potential difference between the belt-like image carrier and the transfer roll becomes optimum for cleaning, and the output value of the cleaning bias voltage is controlled according to a use history of the image forming apparatus.

3. An image forming apparatus comprising:

a belt-like image carrier which holds a visible image formed of a charged colorant and is circularly moved;

a transfer roll which is disposed to be brought into press contact with a front surface of the image carrier through a recording medium and collectively transfers the visible image on the image carrier onto the recording medium;

a backup roll which is disposed opposite to the transfer roll to be brought into press contact with a rear surface of the belt-like image carrier and forms a transfer nip region of a predetermined width with the transfer roll, and a transfer bias application part which applies a transfer bias voltage to at least one of the backup roll and the transfer roll, wherein a cleaning bias voltage having a polarity opposite to the transfer bias voltage is applied to at least one of the backup roll and the transfer roll, and a resistor of a predetermined value corresponding to a system resistance between the backup roll and the transfer roll is provided between a cleaning bias power supply and a transfer portion so that a potential difference between the belt-like image carrier and the transfer roll becomes a value suitable for cleaning.

4. An image forming apparatus according to claim 3, wherein the resistance value of the resistor is set so that an optimum cleaning bias can always be applied against a change of the system resistance of the transfer portion.

* * * * *